US009515365B2

(12) United States Patent
McCormack et al.

(10) Patent No.: US 9,515,365 B2
(45) Date of Patent: Dec. 6, 2016

(54) DIELECTRIC COUPLING SYSTEMS FOR EHF COMMUNICATIONS

(71) Applicant: Keyssa, Inc., Campbell, CA (US)

(72) Inventors: Gary D. McCormack, Tigard, OR (US); Yanghyo Kim, Los Angeles, CA (US); Emilio Sovero, Thousand Oaks, CA (US)

(73) Assignee: Keyssa, Inc., Campbell, CA (US)

( * ) Notice: Subject to any disclaimer, the term of this patent is extended or adjusted under 35 U.S.C. 154(b) by 64 days.

(21) Appl. No.: 13/963,199

(22) Filed: Aug. 9, 2013

(65) Prior Publication Data

US 2014/0043208 A1 Feb. 13, 2014

Related U.S. Application Data

(60) Provisional application No. 61/681,792, filed on Aug. 10, 2012.

(51) Int. Cl.

| | |
|---|---|
| ***H01Q 1/50*** | (2006.01) |
| ***H01P 3/12*** | (2006.01) |
| ***H01P 3/16*** | (2006.01) |

(52) U.S. Cl.

CPC ..... *H01P 3/122* (2013.01); *H01P 3/165* (2013.01); *H01Q 1/50* (2013.01)

(58) Field of Classification Search

CPC ..... H01Q 1/50; H01Q 3/122; H01Q 3/165; H01P 3/122; H01P 3/165

USPC ..... 343/905; 333/239

See application file for complete search history.

(56) References Cited

U.S. PATENT DOCUMENTS

| | | | |
|---|---|---|---|
| 2,753,551 | A | 7/1956 | Richmond |
| 3,796,831 | A | 3/1974 | Bauer |
| 3,971,930 | A | 7/1976 | Fitzmaurice et al. |
| 3,987,365 | A | 10/1976 | Okada et al. |
| 4,293,833 | A | 10/1981 | Popa |
| 4,485,312 | A | 11/1984 | Kusakabe et al. |
| 4,497,068 | A | 1/1985 | Fischer |
| 4,525,693 | A | 6/1985 | Suzuki et al. |
| 4,694,504 | A | 9/1987 | Porter et al. |
| 4,771,294 | A | 9/1988 | Wasilousky |
| 4,800,350 | A | 1/1989 | Bridges et al. |
| 4,875,026 | A | 10/1989 | Walter et al. |
| 4,946,237 | A | 8/1990 | Arroyo et al. |

(Continued)

FOREIGN PATENT DOCUMENTS

| | | | |
|---|---|---|---|
| CN | 2237914 | Y | 10/1996 |
| CN | 1178402 | A | 4/1998 |

(Continued)

OTHER PUBLICATIONS

Bluetooth Audio Dongle Receiver 3.5mm Stereo, Feb. 8, 2013.

(Continued)

*Primary Examiner* — Hoang V Nguyen

(74) *Attorney, Agent, or Firm* — Fenwick & West LLP

(57) ABSTRACT

Dielectric coupler devices and dielectric coupling systems for communicating EHF electromagnetic signals, and their methods of use. The coupler devices include an electrically conductive body having a major surface, the electrically conductive body defining an elongate recess, and the elongate recess having a floor, where a dielectric body is disposed in the elongate recess and configured to conduct an EHF electromagnetic signal.

34 Claims, 9 Drawing Sheets

(56) References Cited

U.S. PATENT DOCUMENTS 5,164,942 A 11/1992 Kamerman et al.
5,199,086 A 3/1993 Johnson et al.
5,471,668 A 11/1995 Soenen et al.
5,543,808 A 8/1996 Feigenbaum et al.
5,621,913 A 4/1997 Tuttle et al.
5,749,052 A 5/1998 Hidem et al.
5,754,948 A 5/1998 Metze
5,773,878 A 6/1998 Lim et al.
5,786,626 A 7/1998 Brady et al.
5,861,782 A 1/1999 Saitoh
5,921,783 A 7/1999 Fritsch et al.
5,941,729 A 8/1999 Sri-Jayantha
5,943,374 A 8/1999 Kokuryo et al.
5,956,626 A 9/1999 Kaschke et al.
6,011,785 A 1/2000 Carney
6,072,433 A 6/2000 Young et al.
6,252,767 B1 6/2001 Carlson
6,351,237 B1 2/2002 Martek et al.
6,373,447 B1 4/2002 Rostoker et al.
6,490,443 B1 12/2002 Freeny, Jr.
6,492,973 B1 12/2002 Kuroki et al.
6,534,784 B2 3/2003 Eliasson et al.
6,542,720 B1 4/2003 Tandy
6,590,544 B1 7/2003 Filipovic
6,607,136 B1 8/2003 Alsman et al.
6,647,246 B1 11/2003 Lu
6,718,163 B2 4/2004 Tandy
6,768,770 B1 7/2004 Lipperer
6,803,841 B2 10/2004 Saitoh et al.
6,915,529 B1 7/2005 Suematsu et al.
6,967,347 B2 11/2005 Estes et al.
7,050,763 B2 5/2006 Stengel et al.
7,107,019 B2 9/2006 Tandy
7,113,087 B1 9/2006 Casebolt et al.
7,213,766 B2 5/2007 Ryan et al.
7,311,526 B2 12/2007 Rohrbach et al.
7,512,395 B2 3/2009 Beukema et al.
7,517,222 B2 4/2009 Rohrbach et al.
7,593,708 B2 9/2009 Tandy
7,598,923 B2 10/2009 Hardacker et al.
7,599,427 B2 10/2009 Bik
7,612,630 B2 11/2009 Miller
7,617,342 B2 11/2009 Rofougaran
7,645,143 B2 1/2010 Rohrbach et al.
7,656,205 B2 2/2010 Chen et al.
7,664,461 B2 2/2010 Rofougaran et al.
7,760,045 B2 7/2010 Kawasaki
7,761,092 B2 7/2010 Desch et al.
7,768,457 B2 8/2010 Pettus et al.
7,769,347 B2 8/2010 Louberg et al.
7,778,621 B2 8/2010 Tandy
7,791,167 B1 9/2010 Rofougaran
7,820,990 B2 10/2010 Schroeder et al.
7,881,675 B1 2/2011 Gazdzinski
7,881,753 B2 2/2011 Rofougaran
7,889,022 B2 2/2011 Miller
7,907,924 B2 3/2011 Kawasaki
7,929,474 B2 4/2011 Pettus et al.
7,975,079 B2 7/2011 Bennett et al.
8,013,610 B1 9/2011 Merewether et al.
8,014,416 B2 9/2011 Ho et al.
8,023,886 B2 9/2011 Rofougaran
8,036,629 B2 10/2011 Tandy
8,041,227 B2 10/2011 Holcombe et al.
8,063,769 B2 11/2011 Rofougaran
8,081,699 B2 12/2011 Siwiak et al.
8,087,939 B2 1/2012 Rohrbach et al.
8,121,542 B2 2/2012 Zack et al.
8,131,645 B2 3/2012 Lin et al.
8,183,935 B2 5/2012 Milano et al.
8,244,175 B2 8/2012 Rofougaran
8,244,179 B2 8/2012 Dua
8,279,611 B2 10/2012 Wong et al.
8,339,258 B2 12/2012 Rofougaran
8,346,847 B2 1/2013 Steakley
8,422,482 B2 4/2013 Sugita
8,554,136 B2 10/2013 McCormack
8,634,767 B2 1/2014 Rofougaran et al.
8,755,849 B2 6/2014 Rofougaran et al.
8,794,980 B2 8/2014 McCormack
8,811,526 B2 8/2014 McCormack et al.
8,812,833 B2 8/2014 Liu et al.
8,939,773 B2 1/2015 McCormack
9,374,154 B2 6/2016 Kyles et al.
2002/0008665 A1 1/2002 Takenoshita
2002/0027481 A1 3/2002 Fiedziuszko
2002/0058484 A1 5/2002 Bobier et al.
2002/0106041 A1 8/2002 Chang et al.
2002/0118083 A1 8/2002 Pergande
2002/0140584 A1 10/2002 Maeda et al.
2003/0025626 A1 2/2003 McEwan
2003/0088404 A1 5/2003 Koyanagi
2003/0137371 A1 7/2003 Saitoh et al.
2004/0043734 A1 3/2004 Hashidate
2004/0160294 A1 8/2004 Elco
2004/0214621 A1 10/2004 Ponce De Leon et al.
2005/0032474 A1 2/2005 Gordon
2005/0099242 A1 5/2005 Sano
2005/0109841 A1 5/2005 Ryan et al.
2005/0124307 A1 6/2005 Ammar
2005/0140436 A1 6/2005 Ichitsubo et al.
2006/0003710 A1 1/2006 Nakagawa et al.
2006/0029229 A1 2/2006 Trifonov et al.
2006/0038168 A1 2/2006 Estes et al.
2006/0051981 A1 3/2006 Neidlein et al.
2006/0077043 A1 4/2006 Amtmann et al.
2006/0082518 A1 4/2006 Ram
2006/0128372 A1 6/2006 Gazzola
2006/0140305 A1 6/2006 Netsell et al.
2006/0159158 A1 7/2006 Moore et al.
2006/0166740 A1 7/2006 Sufuentes
2006/0258289 A1 11/2006 Dua
2006/0276157 A1 12/2006 Chen et al.
2007/0010295 A1 1/2007 Greene
2007/0024504 A1 2/2007 Matsunaga
2007/0035917 A1 2/2007 Hotelling et al.
2007/0063056 A1 3/2007 Gaucher et al.
2007/0070814 A1 3/2007 Frodyma et al.
2007/0147425 A1 6/2007 Lamoureux et al.
2007/0229270 A1 10/2007 Rofougaran
2007/0242621 A1 10/2007 Nandagopalan et al.
2007/0273476 A1 11/2007 Yamazaki et al.
2007/0278632 A1 12/2007 Zhao et al.
2008/0002652 A1 1/2008 Gupta et al.
2008/0055093 A1 3/2008 Shkolnikov et al.
2008/0055303 A1 3/2008 Ikeda
2008/0089667 A1 4/2008 Grady et al.
2008/0112101 A1 5/2008 McElwee et al.
2008/0142250 A1 6/2008 Tang
2008/0143435 A1 6/2008 Wilson et al.
2008/0150799 A1 6/2008 Hemmi et al.
2008/0150821 A1 6/2008 Koch et al.
2008/0159243 A1 7/2008 Rofougaran
2008/0165002 A1 7/2008 Tsuji
2008/0165065 A1 7/2008 Hill et al.
2008/0192726 A1 8/2008 Mahesh et al.
2008/0195788 A1 8/2008 Tamir et al.
2008/0197973 A1 8/2008 Enguent
2008/0238632 A1 10/2008 Endo et al.
2008/0289426 A1 11/2008 Kearns et al.
2008/0290959 A1 11/2008 Ali et al.
2008/0293446 A1 11/2008 Rofougaran
2009/0006677 A1 1/2009 Rofougaran
2009/0009337 A1 1/2009 Rofougaran
2009/0015353 A1 1/2009 Rofougaran
2009/0028177 A1 1/2009 Pettus et al.
2009/0029659 A1 1/2009 Gonzalez
2009/0033455 A1 2/2009 Strat et al.
2009/0037628 A1 2/2009 Rofougaran
2009/0073070 A1 3/2009 Rofougaran
2009/0075688 A1 3/2009 Rofougaran
2009/0086844 A1 4/2009 Rofougaran
2009/0091486 A1 4/2009 Wiesbauer et al.
2009/0094506 A1 4/2009 Lakkis

(56) References Cited

U.S. PATENT DOCUMENTS

| | | | |
|---|---|---|---|
| 2009/0098826 | A1 | 4/2009 | Zack et al. |
| 2009/0110131 | A1 | 4/2009 | Bornhoft et al. |
| 2009/0111390 | A1 | 4/2009 | Sutton et al. |
| 2009/0175323 | A1 | 7/2009 | Chung |
| 2009/0180408 | A1 | 7/2009 | Graybeal et al. |
| 2009/0189873 | A1 | 7/2009 | Peterson et al. |
| 2009/0218407 | A1 | 9/2009 | Rofougaran |
| 2009/0218701 | A1 | 9/2009 | Rofougaran |
| 2009/0236701 | A1 | 9/2009 | Sun et al. |
| 2009/0237317 | A1 | 9/2009 | Rofougaran |
| 2009/0239392 | A1 | 9/2009 | Sumitomo et al. |
| 2009/0239483 | A1 | 9/2009 | Rofougaran |
| 2009/0245808 | A1 | 10/2009 | Rofougaran |
| 2009/0257445 | A1 | 10/2009 | Chan et al. |
| 2009/0280765 | A1 | 11/2009 | Rofougaran et al. |
| 2009/0310649 | A1 | 12/2009 | Fisher et al. |
| 2010/0009627 | A1 | 1/2010 | Huomo |
| 2010/0063866 | A1 | 3/2010 | Kinoshita et al. |
| 2010/0071031 | A1 | 3/2010 | Carter et al. |
| 2010/0103045 | A1 | 4/2010 | Liu et al. |
| 2010/0120406 | A1 | 5/2010 | Banga et al. |
| 2010/0127804 | A1 | 5/2010 | Vouloumanos |
| 2010/0149149 | A1 | 6/2010 | Lawther |
| 2010/0159829 | A1 | 6/2010 | McCormack |
| 2010/0167645 | A1 | 7/2010 | Kawashimo |
| 2010/0202345 | A1 | 8/2010 | Jing et al. |
| 2010/0202499 | A1 | 8/2010 | Lee et al. |
| 2010/0203833 | A1 | 8/2010 | Dorsey |
| 2010/0231452 | A1 | 9/2010 | Babakhani et al. |
| 2010/0260274 | A1 | 10/2010 | Yamada et al. |
| 2010/0265648 | A1 | 10/2010 | Hirabayashi |
| 2010/0277394 | A1 | 11/2010 | Haustein et al. |
| 2010/0282849 | A1 | 11/2010 | Mair |
| 2010/0283700 | A1 | 11/2010 | Rajanish et al. |
| 2010/0285634 | A1 | 11/2010 | Rofougaran |
| 2010/0289591 | A1 | 11/2010 | Garcia |
| 2010/0297954 | A1 | 11/2010 | Rofougaran et al. |
| 2010/0315954 | A1 | 12/2010 | Singh et al. |
| 2011/0009078 | A1 | 1/2011 | Kawamura |
| 2011/0012727 | A1 | 1/2011 | Pance et al. |
| 2011/0038282 | A1 | 2/2011 | Mihota et al. |
| 2011/0044404 | A1 | 2/2011 | Vromans |
| 2011/0047588 | A1 | 2/2011 | Takeuchi et al. |
| 2011/0050446 | A1 | 3/2011 | Anderson et al. |
| 2011/0084398 | A1 | 4/2011 | Pilard et al. |
| 2011/0092212 | A1 | 4/2011 | Kubota |
| 2011/0122932 | A1 | 5/2011 | Lovberg |
| 2011/0127954 | A1 | 6/2011 | Walley et al. |
| 2011/0181484 | A1 | 7/2011 | Pettus et al. |
| 2011/0197237 | A1 | 8/2011 | Turner |
| 2011/0207425 | A1 | 8/2011 | Juntunen et al. |
| 2011/0221582 | A1 | 9/2011 | Chuey et al. |
| 2011/0249659 | A1 | 10/2011 | Fontaine et al. |
| 2011/0250928 | A1 | 10/2011 | Schlub et al. |
| 2011/0285606 | A1 | 11/2011 | De Graauw et al. |
| 2011/0286703 | A1 | 11/2011 | Kishima et al. |
| 2011/0292972 | A1 | 12/2011 | Budianu et al. |
| 2011/0311231 | A1 | 12/2011 | Ridgway et al. |
| 2012/0009880 | A1 | 1/2012 | Trainin et al. |
| 2012/0013499 | A1 | 1/2012 | Hayata |
| 2012/0028582 | A1 | 2/2012 | Tandy |
| 2012/0064664 | A1 | 3/2012 | Yamazaki et al. |
| 2012/0069772 | A1 | 3/2012 | Byrne et al. |
| 2012/0072620 | A1 | 3/2012 | Jeong et al. |
| 2012/0082194 | A1 | 4/2012 | Tam et al. |
| 2012/0083137 | A1 | 4/2012 | Rohrbach et al. |
| 2012/0091799 | A1 | 4/2012 | Rofougaran et al. |
| 2012/0110635 | A1 | 5/2012 | Harvey et al. |
| 2012/0126794 | A1 | 5/2012 | Jensen et al. |
| 2012/0139768 | A1 | 6/2012 | Loeda et al. |
| 2012/0219039 | A1 | 8/2012 | Feher |
| 2012/0249366 | A1 | 10/2012 | Pozgay et al. |
| 2012/0263244 | A1 | 10/2012 | Kyles et al. |
| 2012/0265596 | A1 | 10/2012 | Mazed et al. |
| 2012/0286049 | A1 | 11/2012 | McCormack et al. |
| 2012/0290760 | A1 | 11/2012 | McCormack et al. |
| 2012/0295539 | A1 | 11/2012 | McCormack et al. |
| 2012/0307932 | A1 | 12/2012 | McCormack et al. |
| 2012/0319496 | A1 | 12/2012 | McCormack et al. |
| 2012/0319890 | A1 | 12/2012 | McCormack et al. |
| 2013/0070817 | A1 | 3/2013 | McCormack et al. |
| 2013/0106673 | A1 | 5/2013 | McCormack et al. |
| 2013/0109303 | A1 | 5/2013 | McCormack et al. |
| 2013/0157477 | A1 | 6/2013 | McCormack |
| 2013/0183903 | A1 | 7/2013 | McCormack et al. |
| 2013/0196598 | A1 | 8/2013 | McCormack et al. |
| 2013/0257670 | A1* | 10/2013 | Sovero et al. ..... 343/833 |
| 2013/0278360 | A1 | 10/2013 | Kim et al. |
| 2013/0316653 | A1 | 11/2013 | Kyles et al. |
| 2014/0038521 | A1 | 2/2014 | McCormack |
| 2014/0148193 | A1 | 5/2014 | Kogan et al. |
| 2014/0266331 | A1 | 9/2014 | Arora |
| 2014/0269414 | A1 | 9/2014 | Hyde et al. |
| 2015/0111496 | A1 | 4/2015 | McCormack et al. |

FOREIGN PATENT DOCUMENTS

| | | | |
|---|---|---|---|
| CN | 2313296 | Y | 4/1999 |
| CN | 1389988 | A | 1/2003 |
| CN | 1781255 | A | 5/2006 |
| CN | 1812254 | A | 8/2006 |
| CN | 101090179 | A | 12/2007 |
| CN | 101496298 | A | 7/2009 |
| CN | 201562854 | U | 8/2010 |
| CN | 102156510 | A | 8/2011 |
| CN | 104937956 | A | 9/2015 |
| EP | 0152246 | A2 | 8/1985 |
| EP | 0515187 | A2 | 11/1992 |
| EP | 0789421 | A2 | 8/1997 |
| EP | 0884799 | A2 | 12/1998 |
| EP | 0896380 | A2 | 2/1999 |
| EP | 0996189 | A2 | 4/2000 |
| EP | 1041666 | A1 | 10/2000 |
| EP | 1298809 | A2 | 4/2003 |
| EP | 1357395 | A1 | 10/2003 |
| EP | 1798867 | A2 | 6/2007 |
| EP | 2106192 | A2 | 9/2009 |
| EP | 2309608 | A1 | 4/2011 |
| EP | 2328226 | A1 | 6/2011 |
| EP | 2360923 | A1 | 8/2011 |
| GB | 817349 | | 7/1959 |
| GB | 2217114 | | 10/1989 |
| GB | 2217114 | A | 10/1989 |
| GB | 10-13296 | A | 1/1998 |
| JP | 52-72502 | A | 6/1977 |
| JP | 5-236031 | A | 9/1993 |
| JP | 5-327788 | A | 12/1993 |
| JP | 07-006817 | A | 1/1995 |
| JP | 9-83538 | A | 3/1997 |
| JP | H10-065568 | A | 3/1998 |
| JP | H11-298343 | A | 10/1999 |
| JP | 2000-022665 | A | 1/2000 |
| JP | 2001-153963 | A | 6/2001 |
| JP | 2001-326506 | A | 11/2001 |
| JP | 2001326506 | A | 11/2001 |
| JP | 2002-261514 | A | 9/2002 |
| JP | 2002-265729 | A | 9/2002 |
| JP | 2002261514 | A | 9/2002 |
| JP | 2002265729 | A | 9/2002 |
| JP | 2003-209511 | A | 7/2003 |
| JP | 2004-505505 | A | 2/2004 |
| JP | 2005-117153 | A | 4/2005 |
| JP | 2008-022247 | A | 1/2008 |
| JP | 2008-079241 | | 4/2008 |
| JP | 2008-124917 | A | 5/2008 |
| JP | 2008-129919 | A | 6/2008 |
| JP | 2008-250713 | A | 10/2008 |
| JP | 2008 252566 | A | 10/2008 |
| JP | 2008252566 | A | 10/2008 |
| JP | 2009-231114 | | 7/2009 |
| JP | 2009-239842 | A | 10/2009 |
| JP | 2010-183055 | A | 8/2010 |
| JP | 2010-531035 | A | 9/2010 |
| JP | 2011-022640 | A | 2/2011 |

(56) References Cited

FOREIGN PATENT DOCUMENTS

| | | | |
|---|---|---|---|
| JP | 2011-41078 | A | 2/2011 |
| JP | 2011-044944 | A | 3/2011 |
| JP | 2011-176672 | A | 9/2011 |
| JP | 2014-516221 | | 7/2014 |
| TW | 200520434 | A | 6/2005 |
| TW | 200810444 | A | 2/2008 |
| TW | 201249293 | A1 | 12/2012 |
| WO | WO 97/32413 | A | 9/1997 |
| WO | WO 2006/133108 | A2 | 12/2006 |
| WO | WO 2009/113373 | A1 | 9/2009 |
| WO | WO 2011/114737 | A1 | 9/2011 |
| WO | WO 2011/114738 | A1 | 9/2011 |
| WO | WO 2012/129426 | A3 | 9/2012 |
| WO | WO 2012/154550 | A1 | 11/2012 |
| WO | WO 2012/155135 | A3 | 11/2012 |
| WO | WO 2012/166922 | A1 | 12/2012 |
| WO | WO 2012/174350 | A1 | 12/2012 |
| WO | WO 2013/006641 | A3 | 1/2013 |
| WO | WO 2013/040396 | A1 | 3/2013 |
| WO | WO 2013/059801 | A1 | 4/2013 |
| WO | WO 2013/059802 | A1 | 4/2013 |
| WO | WO 2013/090625 | A1 | 6/2013 |
| WO | WO 2013/131095 | A1 | 9/2013 |
| WO | WO 2013/134444 | A1 | 9/2013 |
| WO | WO 2014/026191 | A1 | 2/2014 |

OTHER PUBLICATIONS

Bluetooth Headset, Jabra clipper, Jul. 28, 2010.
Chinese Office Action, Chinese Application No. 201280025060.8, Oct. 30, 2014, 8 pages (with concise explanation of relevance).
ECMA Standard: "Standard ECMA-398: Close Proximity Electric Induction Wireless Communications," Jun. 1, 2011, pp. 1-100, May be retrieved from the Internet<URL:http://www.ecma-international.org/publications/standards/Ecma-398.htm>.
Future Technology Devices Interntional Limited (FTDI) "Technical Note TN_I 13 Simplified Description ofUSB Device Enumeration", Doc. Ref. No. FT_000180, Version 1.0, Issue Date Oct. 28, 2009, 19 pages.
Goldstone , L. L., "MM Wave Transmission Polarizer", International Symposium Digest—Antennas & Propagation vol. 2, Jun. 1979, 5 pages.
Japanese Office Action, Japanese Patent Office, "Notice of Reasons for Rejection" in connection with related Japanese Patent Application No. 2014-501249, dated Jul. 22, 2014, 7 pages.
Japanese Office Action, Japanese Application No. 2014-513697, Jan. 20, 2015, 7 pages.
Juntunen, E. A., "60 GHz CMOS Pico-Joule/Bit Oook Receiver Design for Multi-Gigabit Per Second Wireless Communications" thesis paper, Aug. 2008, 52 pages.
Korean Office Action, Korean Application No. 10-2013-7027865, Oct. 22, 2014, 12 pages.
Office of Engineering and Technology Federal Communications Commission, "Understanding the FCC Regulations for Low-Power, Non-Licensed Transmitters", OET Bulletin No. 63, Oct. 1993, 34 pages.
PCT International Search Report, PCT Patent Application No. PCT/US2013/027835, dated May 3, 2013, 4 pages.
PCT Written Opinion, PCT Patent Application No. PCT/US2013/027835, May 3, 2013, 8 pages.
PCT International Search Report, PCT Patent Application No. PCT/US2013/029469, Jun. 6, 2013, 5 pages.
PCT Written Opinion, PCT Patent Application No. PCT/US2013/029469, Jun. 6, 2013, 5 pages.
PCT International Search Report, PCT Patent Application No. PCT/US2013/023665, Jun. 20, 2013, 5 pages.
PCT Written Opinion, PCT Patent Application No. PCT/US2013/023665, Jun. 20, 2013, 10 pages.
PCT International Search Report, PCT Patent Application No. PCT/US2012/040214, Aug. 21, 2012, 3 pages.
PCT Written Opinion, PCT Patent Application No. PCT/US2012/040214, Aug. 21, 2012, 8 pages.
PCT International Search Report, PCT Patent Application No. PCT/US2012/042616, Oct. 1, 2012, 4 pages.
PCT Written Opinion, PCT Patent Application No. PCT/US2012/042616, Oct. 1, 2012, 10 pages.
PCT International Search Report, PCT Patent Application No. PCT/US2012/030166, Oct. 31, 2010, 6 pages.
PCT Written Opinion, PCT Patent Application No. PCT/US2012/030166, Oct. 31, 2010, 9 pages.
PCT International Search Report, PCT Patent Application No. PCT/US2012/055488, Dec. 13, 2012, 4 pages.
PCT Written Opinion, PCT Patent Application No. PCT/US2012/055488, Dec. 13, 2012, 8 pages.
PCT International Search Report, PCT Patent Application No. PCT/US2012/045444, Jan. 21, 2013, 7 pages.
PCT Written Opinion, PCT Patent Application No. PCT/US2012/045444, Jan. 21, 2013, 9 pages.
PCT International Search Report, PCT Patent Application No. PCT/US2012/037795, Jan. 21, 2013, 7 pages.
PCT Written Opinion, PCT Patent Application No. PCT/US2012/037795, Jan. 21, 2013, 12 pages.
PCT International Search Report, PCT Patent Application No. PCT/US2012/061345, Jan. 24, 2013, 4 pages.
PCT Written Opinion, PCT Patent Application No. PCT/US2012/061345, Jan. 24, 2013, 7 pages.
PCT International Search Report, PCT Patent Application No. PCT/US2012/061346, Jan. 24, 2013, 5 pages.
PCT Written Opinion, PCT Patent Application No. PCT/US2012/061346, Jan. 24, 2013, 9 pages.
PCT International Search Report, PCT Patent Application No. PCT/US2012/069576, May 2, 2013, 3 pages.
PCT Written Opinion, PCT Patent Application No. PCT/US2012/069576, May 2, 2013, 13 pages.
PCT International Search Report, PCT Patent Application No. PCT/US2013/028896, Sep. 26, 2013, 4 pages.
PCT Written Opinion, PCT Patent Application No. PCT/US2013/028896, Sep. 26, 2013, 4 pages.
PCT International Search Report, PCT Patent Application No. PCT/US2013/046631, Sep. 20, 2013, 4 pages.
PCT Written Opinion, PCT Patent Application No. PCT/US2013/046631, Sep. 20, 2013, 6 pages.
PCT International Search Report, PCT Patent Application No. PCT/US2013/054292, Nov. 29, 2013, 4 pages.
PCT Written Opinion, PCT Patent Application No. PCT/US2013/054292, Nov. 29, 2013, 7 pages.
PCT International Search Report and Written Opinion, PCT Application No. PCT/US2014/024027, Jul. 21, 2014, 15 pages.
PCT International Search Report, PCT Application No. PCT/US2013/075222, Jul. 17, 2014, 4 pages.
PCT Written Opinion, PCT Application No. PCT/US2013/075222, Jul. 17, 2014, 8 pages.
PCT International Search Report, PCT Application No. PCT/US2013/075892, Apr. 23, 2014, 4 pages.
PCT Written Opinion, PCT Application No. PCT/US2013/075892, Apr. 23, 2014, 8 pages.
PCT International Search Report and Written Opinion, PCT Application No. PCT/US2013/033394, Aug. 8, 2013, 10 pages.
PCT International Search Report and Written Opinion, PCT Application No. PCT/US2013/055487, Jan. 24, 2014, 9 pages.
PCT International Search Report and Written Opinion, PCT Application No. PCT/US2013/076687, May 21, 2014, 20 pages.
PCT International Search Report and Written Opinion, PCT Application No. PCT/US2014/030115, Sep. 22, 2014, 15 pages.
PCT International Search Report and Written Opinion, PCT Application No. PCT/US2013/059811, Dec. 2, 2013, 11 pages.
Philips, I2S Bus Specification, Jun. 5, 1996.
RF Power Amplifier, Mar. 22, 2008, 1 page, May be Retrieved at <http://en.wikipedia.org/wiki/RF_power_amplifier>.
Silicon Labs USB-to-12S Audio Bridge Chip Brings Plug-and-Play Simplicity to Audio Design, Cision Wire, Feb. 4, 2013.

(56) References Cited

OTHER PUBLICATIONS

USB Made Simple, MQP Electronics Ltd, 2006-2008 (78 pages).
"Understanding the FCC Regulations for Low-Power Non-Licensed Transmitters", Office of Engineering and Technology, Federal Communications Commission, OET Bulletin No. 63, Oct. 1993.
Universal Serial Bus, Wikipedia, 2012 (32 pages).
Vahle Electrification Systems, "CPS Contactless Power System", Catalog No. 9d/E, 2004, 12 pages.
Wireless HD: "WirelessHD Specification Version 1.1 Overview," May 1, 2010, pp. 1-95, May be retrieved from the Internet<URL:http://www.wirelesshd.org/pdfs/WirelessHD-Specification-Overview-v1.1May2010.pdf>.
United States Office Action, U.S. Appl. No. 13/485,306, Sep. 26, 2013, 11 pages.
United States Office Action, U.S. Appl. No. 13/541,543, Feb. 12, 2015, 25 pages.
United States Office Action, U.S. Appl. No. 13/541,543, Oct. 28, 2014, 42 pages.
United States Office Action, U.S. Appl. No. 13/427,576, Oct. 30, 2014, 6 pages.
United States Office Action, U.S. Appl. No. 13/524,956, Feb. 9, 2015, 17 pages.
United States Office Action, U.S. Appl. No. 13/524,963, Mar. 17, 2014, 14 pages.
United States Office Action, U.S. Appl. No. 13/657,482, Jan. 2, 2015, 29 pages.
United States Office Action, U.S. Appl. No. 12/655,041, Jun. 7, 2013, 9 pages.
United States Office Action, U.S. Appl. No. 14/047,924, Dec. 19, 2014, 8 pages.
United States Office Action, U.S. Appl. No. 14/047,924, Feb. 27, 2014, 9 pages.
United States Office Action, U.S. Appl. No. 13/784,396, Sep. 11, 2014, 7 pages.
United States Office Action, U.S. Appl. No. 13/760,089, Jul. 7, 2014, 14 pages.
United States Office Action, U.S. Appl. No. 14/596,172, Feb. 10, 2015, 7 pages.
United States Office Action, U.S. Appl. No. 14/462,560, Feb. 13, 2015, 12 pages.
United States Office Action, U.S. Appl. No. 14/026,913, Feb. 25, 2015, 15 pages.
J Pastor Jimenez, Authorized Officer, European Patent Office, "International Search Report" in connection with related PCT Patent Application No. PCT/US2013/054292, 4 pages.
J Pastor Jimenez, Authorized Officer, European Patent Office, "Written Opinion of the International Searching Authority" in connection with related PCT Patent Application No. PCT/US2013/054292, 7 pages.
Chinese Second Office Action, Chinese Application No. 201280025060.8, Jun. 11, 2015, 8 pages.
Japanese Office Action, Japanese Application No. 2014-519270, Mar. 9, 2015, 17 pages.
Japanese Office Action, Japanese Application No. 2014-547442, May 25, 2015, 7 pages.
Japanese Office Action, Japanese Application No. 2015-004839, Aug. 10, 2015, 12 pages.
Korean Office Action, Korean Application No. 10-2013-7027865, Apr. 13, 2015, 8 pages.
Li, X. et al., "Space-Time Transmissions for Wireless Secret-Key Agreement with Information-Theoretic Secrecy," IEEE, 2003, pp. 1-5.
United States Office Action, U.S. Appl. No. 14/135,458, Apr. 13, 2015, 13 pages.
United States Office Action, U.S. Appl. No. 13/541,543, May 28, 2015, 17 pages.
United States Office Action, U.S. Appl. No. 14/047,924, May 21, 2015, 6 pages.
United States Office Action, U.S. Appl. No. 14/026,913, Jun. 5, 2015, 16 pages.
United States Office Action, U.S. Appl. No. 13/922,062, Jul. 23, 2015, 10 pages.
United States Office Action, U.S. Appl. No. 14/109,938, Aug. 14, 2015, 12 pages.
Chinese First Office Action, Chinese Application 201280043190.4, Jan. 21, 2015, 18 pages.
Chinese Second Office Action, Chinese Application 201280043190.4, Oct. 26, 2015, 5 pages.
European Examination Report, European Application No. 13711499.7, Oct. 5, 2015, 8 pages.
Japanese Office Action, Japanese Application No. 2014-513697, Nov. 2, 2015, 5 pages.
United States Office Action, U.S. Appl. No. 14/026,913, Sep. 18, 2015, 9 pages.
United States Office Action, U.S. Appl. No. 13/657,482, Sep. 22, 2015, 24 pages.
United States Office Action, U.S. Appl. No. 14/215,069, Oct. 30, 2015, 15 pages.
United States Office Action, U.S. Appl. No. 14/047,924, Nov. 18, 2015, 7 pages.
United States Office Action, U.S. Appl. No. 14/881,901, Dec. 17, 2015, 15 pages.
United States Office Action, U.S. Appl. No. 13/541,543, Dec. 21, 2015, 20 pages.
Chinese First Office Action, Chinese Application No. 201280038180.1, Dec. 1, 2015, 16 pages.
Chinese Third Office Action, Chinese Application No. 201280025060.8, Dec. 28, 2015, 6 pages.
Chinese First Office Action, Chinese Application No. 201280062118.6, Jan. 5, 2016, 15 pages.
Chinese First Office Action, Chinese Application No. 201380055859.6, Jan. 20, 2016, 5 pages.
Chinese First Office Action, Chinese Application No. 201380048407.5, Feb. 3, 2016, 14 pages.
European Examination Report, European Application No. 13821032.3, Apr. 4, 2016, 3 pages.
Ingerski, J., "Mobile Tactical Communications, The Role of the UHF Follow-On Satellite Constellation and Its Successor, Mobile User Objective System," IEEE, 2002, pp. 302-306.
Japanese Office Action, Japanese Application No. 2014/547442, Mar. 14, 2016, 8 pages.
Taiwan Office Action, Taiwan Application No. 101110057, Mar. 23, 2016, 7 pages.
Taiwan Office Action, Taiwan Application No. 101147406, Mar. 23, 2016, 6 pages.
United States Office Action, U.S. Appl. No. 14/936,877, Mar. 23, 2016, 15 pages.
Japanese Office Action, Japanese Application No. 2015-004839, May 16, 2016, 10 pages.
Taiwan Office Action, Taiwan Application No. 101119491, May 9, 2016, 9 pages.
United States Office Action, U.S. Appl. No. 14/106,765, Jun. 9, 2016, 10 pages.
United States Office Action, U.S. Appl. No. 15/144,756, Jun. 16, 2016, 12 pages.
Chinese First Office Action, Chinese Application No. 201380023102.9, Jun. 14, 2016, 13 pages (with concise explanation of relevance).
Chinese Fourth Office Action, Chinese Application No. 201280025060.8, Jun. 17, 2016, 5 pages.
Chinese Second Office Action, Chinese Application No. 201280038180.1, Aug. 18, 2016, 9 pages (with concise explanation of relevance).
Chinese Second Office Action, Chinese Application No. 201280062118.6, Sep. 6, 2016, 4 pages (with concise explanation of relevance).
Chinese First Office Action, Chinese Application No. 201380071296.X, Sep. 2, 2016, 24 pages (with concise explanation of relevance).
European Communication Under Rule 164(2)(a) EPC, European Application No. 14726242.2, Jul. 11, 2016, 3 pages.

(56) References Cited

OTHER PUBLICATIONS

Korean Office Action, Korean Application No. 10-2015-7029405, Jul. 19, 2016, 4 pages (with concise explanation of relevance).
Taiwan Office Action, Taiwan Application No. 101138870, Jun. 13, 2016, 8 pages.
Taiwan Office Action, Taiwan Application No. 101121492, Jul. 28, 2016, 11 pages.
United States Office Action, U.S. Appl. No. 14/047,924, Aug. 11, 2016, 7 pages.
United States Office Action, U.S. Appl. No. 15/204,988, Aug. 31, 2016, 10 pages.

* cited by examiner

DIELECTRIC COUPLING SYSTEMS FOR EHF COMMUNICATIONS

RELATED PATENTS AND APPLICATIONS

The present application claims the benefit under 35 U.S.C. §119(e) of U.S. Provisional Patent Application Ser. No. 61/681,792 filed Aug. 10, 2012, which is hereby incorporated by reference.

The following U.S. patent applications are also incorporated by reference in their entirety for all purposes: U.S. patent application Ser. No. 13/427,576 filed Mar. 22, 2012; U.S. patent application Ser. No. 13/485,306 filed May 31, 2012; U.S. patent application Ser. No. 13/471,052 filed May 14, 2012; U.S. patent application Ser. No. 13/865,105 filed Apr. 17, 2013; and U.S. patent application Ser. No. 13/922,062 filed Jun. 19, 2013.

TECHNICAL FIELD OF THE DISCLOSURE

This disclosure generally relates to devices, systems, and methods for EHF communications, including communications using dielectric guiding structures.

BACKGROUND

This disclosure generally relates to devices, systems, and methods for EHF communications, including communications using dielectric guiding structures.

Advances in semiconductor manufacturing and circuit design technologies have enabled the development and production of ICs with increasingly higher operational frequencies. In turn, electronic products and systems incorporating such integrated circuits are able to provide much greater functionality than previous generations of products. This additional functionality has generally included the processing of increasingly larger amounts of data at increasingly higher speeds.

Many electronic systems include multiple printed circuit boards (PCBs) upon which these high-speed ICs are mounted, and through which various signals are routed to and from the ICs. In electronic system with at least two PCBs and the need to communicate information between those PCBs, a variety of connector and backplane architectures have been developed to facilitate information flow between the boards. Unfortunately, such connector and backplane architectures introduce a variety of impedance discontinuities into the signal path, resulting in a degradation of signal quality or integrity. Connecting to boards by conventional means, such as signal-carrying mechanical connectors, generally creates discontinuities, requiring expensive electronics to negotiate. Conventional mechanical connectors may also wear out over time, require precise alignment and manufacturing methods, and are susceptible to mechanical jostling.

These characteristics of conventional connectors can lead to degradation of signal integrity and instability of electronic systems needing to transfer data at very high rates, which in turn limits the utility of such products. What is needed are methods and systems capable of coupling discontinuous portions of high-data-rate signal paths without the cost and power consumption associated with physical connectors and equalization circuits, particularly where such methods and systems are readily manufactured, modular, and efficient.

SUMMARY

In one embodiment, the invention includes devices for conducting extremely high frequency (EHF) electromagnetic signals, where the devices include an electrically conductive body that includes a major surface, where the electrically conductive body defines an elongate recess in the electrically conductive body, where the elongate recess has a floor, and a dielectric body disposed in the elongate recess that is configured to conduct an EHF electromagnetic signal.

In another embodiment, the invention includes a device for conducting an EHF electromagnetic signal that includes a first electrically conductive body having a first major surface and a second major surface opposite the first major surface, and a first dielectric body disposed on the first major surface that has a first end and a second end, and where the first dielectric body is configured to conduct the EHF electromagnetic signal between the first and second end. The first electrically conductive body additionally defines at least one aperture extending from the first major surface to the second major surface, where the at least one aperture is proximate one of the first and second ends of the first dielectric body.

In another embodiment, the invention includes EHF communication coupling systems, where such systems include an electrically conductive housing, and an elongate dielectric conduit that has a first end and a second end, where the dielectric conduit is disposed between and at least partially enclosed by the electrically conductive housing. The electrically conductive housing defines a first aperture that is proximate the first end of the elongate dielectric conduit, and a first dielectric extension projects from the first end of the elongate dielectric conduit through the first aperture; and a second aperture that is proximate the second end of the elongate dielectric conduit, and a second dielectric extension that projects from the second end of the elongate dielectric conduit and through the second aperture. The coupling system is configured to propagate at least a portion of an EHF electromagnetic signal between the first dielectric extension and the second dielectric extension by way of the elongate dielectric conduit.

In yet another embodiment, the invention includes methods of communicating using EHF electromagnetic signals along a dielectric conduit. The methods of communicating includes mating a first and a second coupling components to form a coupling, where each coupling component includes an electrically conductive body having a first major surface, where each electrically conductive body defines an elongate recess in the first major surface, each elongate recess has a floor, and each elongate recess has a dielectric body disposed therein. The methods further include bringing the first major surfaces of the electrically conductive bodies into sufficient contact that the conductive bodies of the coupling components collectively form an electrically conductive housing, and the dielectric bodies of the coupling components are superimposed to form a dielectric conduit. The methods further include propagating an EHF electromagnetic signal along the dielectric conduit formed thereby.

Other embodiments of the invention may include corresponding EHF electromagnetic communication systems, EHF electromagnetic communication apparatus, EHF electromagnetic conduits, and EHF electromagnetic conduit components, as well as methods of using the respective systems, apparatus, conduits, and components. Further embodiments, features, and advantages, as well as the structure and operation of the various embodiments are described in detail below with reference to the accompanying drawings.

DETAILED DESCRIPTION

Figure 1:
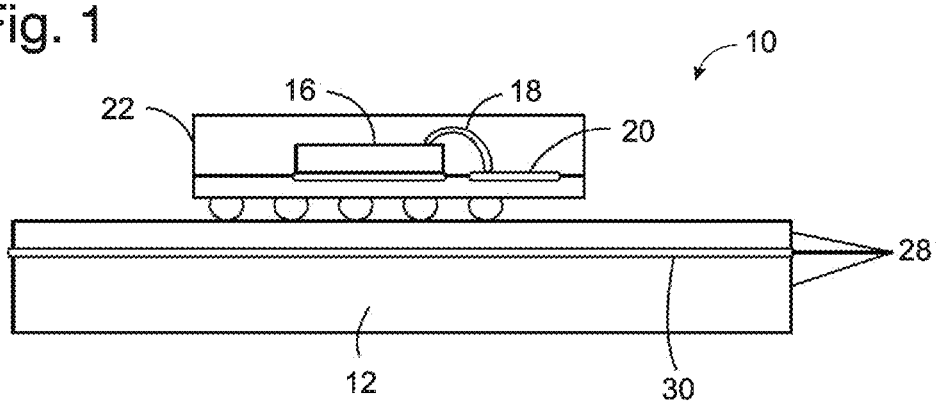
FIG. 1 is a side view of an exemplary EHF communication chip, according to an embodiment of the present invention.

In the following description, numerous specific details are set forth to provide a thorough understanding of the present invention. Reference will be made to certain embodiments of the disclosed subject matter, examples of which are illustrated in the accompanying drawings. While the disclosed subject matter will be described in conjunction with the embodiments, it will be understood that it is not intended to limit the disclosed subject matter to these particular embodiments alone. On the contrary, the disclosed subject matter is intended to cover alternatives, modifications and equivalents that are within the spirit and scope of the disclosed subject matter as defined by the appended claims. In other instances, well known process steps have not been described in detail in order to avoid unnecessarily obscuring the present disclosure.

Moreover, in the following description, numerous specific details are set forth to provide a thorough understanding of the presently disclosed matter. However, it will be apparent to one of ordinary skill in the art that the disclosed subject matter may be practiced without these particular details. In other instances, methods, procedures, and components that are well known to those of ordinary skill in the art are not described in detail to avoid obscuring aspects of the present disclosed subject matter.

Devices, systems, and methods involving dielectric couplings for EHF communication are shown in the drawings and described below.

Devices that provide communication over a communication link may be referred to as communication devices or communication units. A communication unit that operates in the EHF electromagnetic band may be referred to as an EHF communication unit, for example. An example of an EHF communications unit is an EHF comm-link chip. Throughout this disclosure, the terms comm-link chip, comm-link chip package, and EHF communication link chip package will be used interchangeably to refer to EHF antennas embedded in IC packages. Examples of such comm-link chips are described in detail in U.S. patent application Ser. No. 13/485,306, 13/427,576, and Ser. No. 13/471,052.

Devices, systems, and methods involving dielectric couplers for EHF communication are shown in the drawings and described below.

Figure 2:
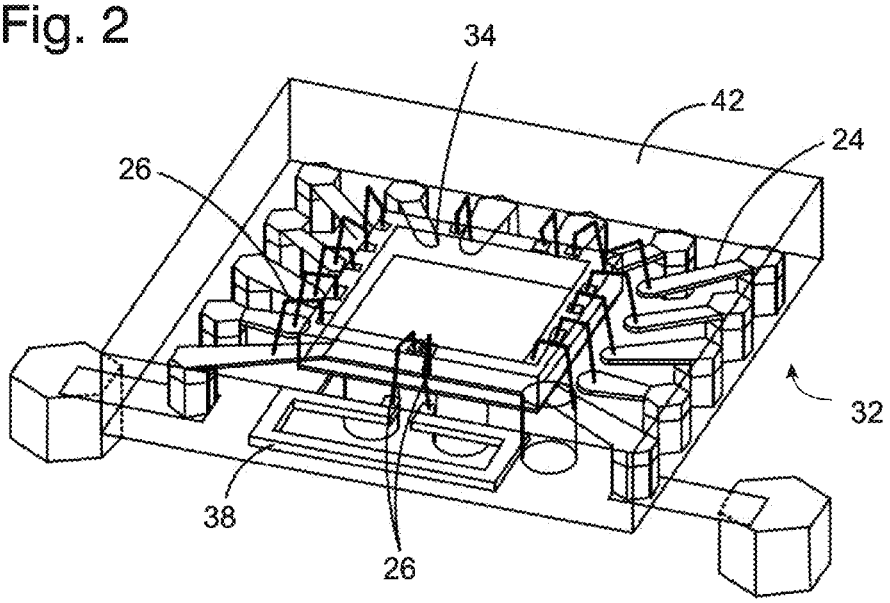
FIG. 2 is a perspective view of an alternative exemplary EHF communication chip, according to an embodiment of the present invention.

FIG. 1 is a side view of an exemplary extremely high frequency (EHF) communication chip 10 showing some internal components, in accordance with an embodiment. As discussed with reference to FIG. 1, the EHF communication chip 10 may be mounted on a connector printed circuit board (PCB) 12 of the EHF communication chip 10. FIG. 2 shows a similar illustrative EHF communication chip 32. It is noted that FIG. 1 portrays the EHF communication chip 10 using computer simulation graphics, and thus some components may be shown in a stylized fashion. The EHF communication chip 10 may be configured to transmit and receive extremely high frequency signals. As illustrated, the EHF communication chip 10 can include a die 16, a lead frame (not shown), one or more conductive connectors such as bond wires 18, a transducer such as antenna 20, and an encapsulating material 22. The die 16 may include any suitable structure configured as a miniaturized circuit on a suitable die substrate, and is functionally equivalent to a component also referred to as a "chip" or an "integrated circuit (IC)." The die substrate may be formed using any suitable semiconductor material, such as, but not limited to, silicon. The die 16 may be mounted in electrical communication with the lead frame. The lead frame (similar to 24 of FIG. 2) may be any suitable arrangement of electrically conductive leads configured to allow one or more other circuits to operatively connect with the die 16. The leads of the lead frame (See 24 of FIG. 2) may be embedded or fixed in a lead frame substrate. The lead frame substrate may be formed using any suitable insulating material configured to substantially hold the leads in a predetermined arrangement.

Further, the electrical communication between the die 16 and leads of the lead frame may be accomplished by any suitable method using conductive connectors such as, one or more bond wires 18. The bond wires 18 may be used to electrically connect points on a circuit of the die 16 with corresponding leads on the lead frame. In another embodiment, the die 16 may be inverted and conductive connectors including bumps, or die solder balls rather than bond wires 16, which may be configured in what is commonly known as a "flip chip" arrangement.

The antenna 20 may be any suitable structure configured as a transducer to convert between electrical and electromagnetic signals. The antenna 20 may be configured to operate in an EHF spectrum, and may be configured to transmit and/or receive electromagnetic signals, in other words as a transmitter, a receiver, or a transceiver. In an embodiment, the antenna 20 may be constructed as a part of the lead frame (see 24 in FIG. 2). In another embodiment, the antenna 20 may be separate from, but operatively connected to the die 16 by any suitable method, and may be located adjacent to the die 16. For example, the antenna 20 may be connected to the die 16 using antenna bond wires (similar to 26 of FIG. 2). Alternatively, in a flip chip configuration, the antenna 20 may be connected to the die 16 without the use of the antenna bond wires. In other embodiments, the antenna 20 may be disposed on the die 16 or on the PCB 12.

Further, the encapsulating material 22 may hold the various components of the EHF communication chip 10 in fixed relative positions. The encapsulating material 22 may be any suitable material configured to provide electrical insulation and physical protection for the electrical and electronic components of first EHF communication chip 10. For example, the encapsulating material 22 may be a mold compound, glass, plastic, or ceramic. The encapsulating material 22 may be formed in any suitable shape. For example, the encapsulating material 22 may be in the form of a rectangular block, encapsulating all components of the EHF communication chip 10 except the unconnected leads of the lead frame. One or more external connections may be formed with other circuits or components. For example, external connections may include ball pads and/or external solder balls for connection to a printed circuit board.

Further, the EHF communication chip 10 may be mounted on a connector PCB 12. The connector PCB 12 may include one or more laminated layers 28, one of which may be PCB ground plane 30. The PCB ground plane 30 may be any suitable structure configured to provide an electrical ground to circuits and components on the PCB 12.

FIG. 2 is a perspective view of an EHF communication chip 32 showing some internal components. It is noted that FIG. 2 portrays the EHF communication chip 32 using computer simulation graphics, and thus some components may be shown in a stylized fashion. As illustrated, the EHF communication chip 32 can include a die 34, a lead frame 24, one or more conductive connectors such as bond wires 36, a transducer such as antenna 38, one or more antenna bond wires 40, and an encapsulating material 42. The die 34, the lead frame 24, one or more bond wires 36, the antenna 38, the antenna bond wires 40, and the encapsulating material 42 may have functionality similar to components such as the die 16, the lead frame, the bond wires 18, the antenna 20, the antenna bond wires, and the encapsulating material 22 of the EHF communication chip 10 as described in FIG. 1. Further, the EHF communication chip 32 may include a connector PCB (similar to PCB 12).

In FIG. 2, it may be seen that the die 34 is encapsulated in the EHF communication chip 32, with the bond wires 26 connecting the die 34 with the antenna 38. In this embodiment, the EHF communication chip 32 may be mounted on the connector PCB. The connector PCB (not shown) may include one or more laminated layers (not shown), one of which may be PCB ground plane (not shown). The PCB ground plane may be any suitable structure configured to provide an electrical ground to circuits and components on the PCB of the EHF communication chip 32.

EHF communication chips 10 and 32 may be configured to allow EHF communication therebetween. Further, either of the EHF communication chips 10 or 32 may be configured to transmit and/or receive electromagnetic signals, providing one or two-way communication between the EHF communication chips. In one embodiment, the EHF communication chips may be co-located on a single PCB and may provide intra-PCB communication. In another embodiment, the EHF communication chips may be located on a first and second PCB, and may therefore provide inter-PCB communication.

Figure 3:
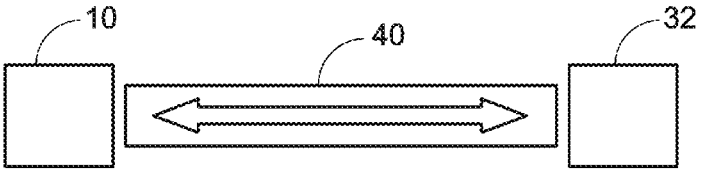
FIG. 3 is a schematic depicting an EHF communication system according to an embodiment of the present invention.

In some situations a pair of EHF communication chips such as 10 and 32 may be mounted sufficiently far apart that EHF electromagnetic signals may not be reliably exchanged between them. In these cases it may be desirable to provide improved signal transmission between a pair of EHF communication chips. For example, one end of a coupler device or coupling system that is configured for the propagation of electromagnetic EHF signals may be disposed adjacent to a source of an EHF electromagnetic signal while the other end of the coupler device or coupling system may be disposed adjacent to a receiver for the EHF electromagnetic signal. The EHF electromagnetic signal may be directed into the coupler device or coupling system from the signal source, propagating along the long axis of the device or system, and received at the signal receiver. Such an EHF communication system is depicted schematically in FIG. 3, including a dielectric coupler device 40 configured for the propagation of electromagnetic EHF signals between EHF communication chips 10 and 32.

The coupler devices and coupling systems of the present invention may be configured to facilitate the propagation of Extremely High Frequency (EHF) electromagnetic signals along a dielectric body, and therefore may facilitate communication of EHF electromagnetic signals between a transmission source and a transmission destination.

Figure 4:
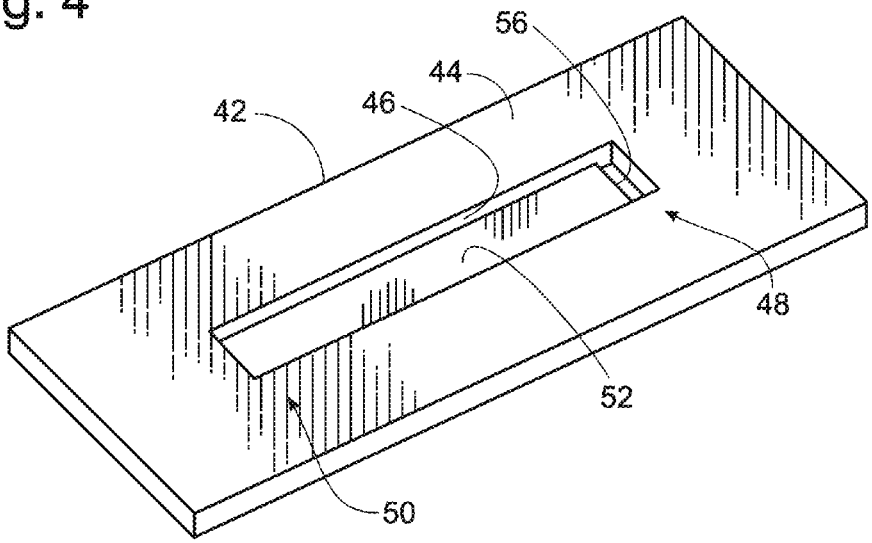
FIG. 4 is a perspective view of an electrically conductive body according to an embodiment of the present invention.

FIG. 4 depicts an electrically conductive body 42, which is configured to have at least one major surface 44. Electrically conductive body 42 may include any suitably rigid or semi-rigid material, provided that the material displays sufficient electrical conductivity. In one embodiment of the invention, some or all of the conductive body 42 may be configured to be used as a component of a housing or a case for an electronic device. The electrically conductive body may have any appropriate geometry provided that the conductive body includes at least one major surface. For example, the electrically conductive body may be substantially planar. Where the electrically conductive body is substantially planar, the conductive body may define a regular shape, such as a parallelogram or a circle, or the conductive body may have an irregular shape, such as an arc. Where the electrically conductive body is nonplanar, the conductive body may define a curved major surface, so as to resemble a section of the surface of a sphere, a cylinder, a cone, a torus, or the like.

The electrically conductive body may define at least one elongate recess 46 in major surface 44. By virtue of being elongate, the elongate recess 46 has a first end 48 and a second end 50. Additionally, the bottom of elongate recess 46 in conductive body 42 may be defined by a recess floor 52. In one embodiment of the invention, the conductive body 42 has at least two major surfaces, where the second major surface may be on an opposing side of the conductive body 42 from the first major surface. As illustrated in FIG. 4, conductive body 42 may display a substantially planar geometry, as well as a substantially rectangular periphery. Where the conductive body has a planar geometry, then the second major surface 54 of the conductive body 42 may be on the opposite side of the planar conductive body from the first major surface 44.

It is seen in this example that elongate recess 46, and correspondingly recess floor 52, extend in a direction generally along the first major surface 44. Where the first major surface 44 extends in a plane proximate to the elongate recess 46, floor 52 may also be planar and may be coplanar to the plane of the first major surface proximate to the elongate recess 46. As will be seen in some examples, the floor may also extend in a direction transverse to the plane of the first major surface proximate to the elongate recess 46.

Also as shown in FIG. 4, the floor 52 of the elongate recess 46 may define an aperture 56. Aperture 56 may extend through floor 52, such that the aperture 56 extends to the second major surface 54 of the conductive body 52. In one embodiment, the aperture 56 may be formed as a slot.

Figure 5:
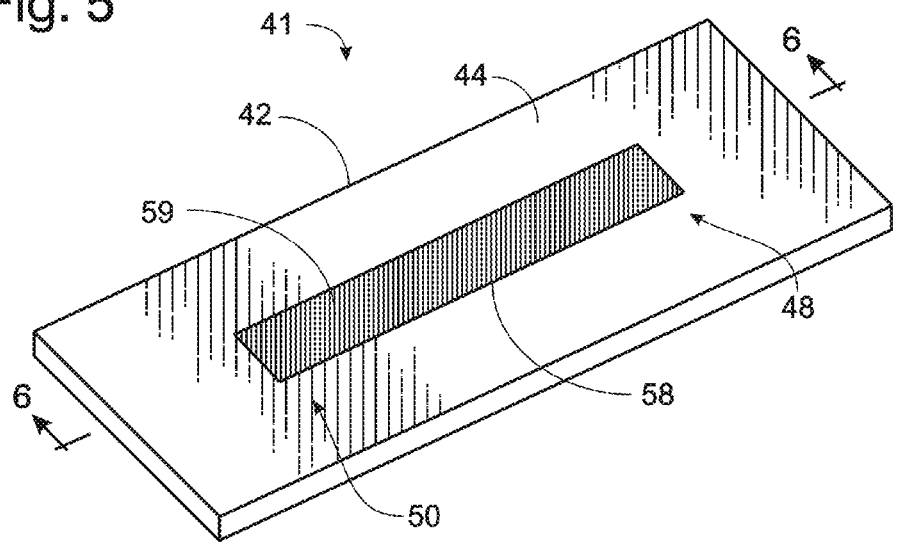
FIG. 5 is a perspective view of dielectric coupler device according to an embodiment of the present invention, including the electrically conductive body of FIG. 1.

As shown in FIG. 5, the elongate recess 46 of the conductive body 42 may include a dielectric body 58 that includes a first dielectric material that extends along the longitudinal axis of the elongate recess 46, forming a dielectric coupler device. The dielectric body 58 may be referred to as a waveguide or dielectric waveguide, and is typically configured to guide (or propagate) a polarized EHF electromagnetic signal along the length of the dielectric body. The dielectric body 58 preferably includes a first dielectric material having a dielectric constant of at least about 2.0. Materials having significantly higher dielectric constants may result in a reduction of the preferred dimensions of the elongate body, due to a reduction in wavelength when an EHF signal enters a material having a higher dielectric constant. Preferably, the elongate body includes a plastic material that is a dielectric material.

In one embodiment of the invention, the dielectric body has a longitudinal axis substantially parallel to the longitudinal axis of the elongate recess, and a cross-section of the dielectric body 58 orthogonal to the longitudinal axis exhibits a major axis extending across the cross-section along the largest dimension of the cross-section, and a minor axis of the cross-section extending across the cross-section along the largest dimension of the cross-section that is oriented at a right angle to the major axis. For each such cross-section, the cross-section has a first dimension along its major axis, and a second dimension along its minor axis. In order to enhance the ability of the dielectric body 58 to internally propagate an electromagnetic EHF signal, each dielectric body may be sized appropriately so that the length of the first dimension of each cross-section is greater than the wavelength of the electromagnetic EHF signal to be propagated along the conduit; and the second dimension is less than the wavelength of the electromagnetic EHF signal to be propagated along the conduit. In an alternative embodiment of the invention, the first dimension is greater than 1.4 times the wavelength of the electromagnetic EHF signal to be propagated, and the second dimension is not greater than about one-half of the wavelength of the electromagnetic EHF signal to be propagated.

The dielectric body 58 may have any of a variety of potential geometries, but is typically configured to substantially occupy the elongate recess 46. The dielectric body 58 may be shaped so that each cross-section of the dielectric body 58 has an outline formed by some combination of straight and/or continuously curving line segments. In one embodiment, each cross-section has an outline that defines a rectangle, a rounded rectangle, a stadium, or a superellipse, where superellipse includes shapes including ellipses and hyperellipses.

In one embodiment, and as shown in FIG. 5, the dielectric body 58 defines an elongate cuboid. That is, dielectric body 58 may be shaped so that at each point along its longitudinal axis, a cross-section of the dielectric body 58 orthogonal to the longitudinal axis defines a rectangle.

The dielectric body 58 may have an upper or mating surface 59 at least part of which may be continuous and/or coplanar with the first major surface 44 around and adjacent to the first elongate recess. In some embodiments, the upper surface 59 may be raised above the first major surface 44 or recessed below the first major surface 44, or both partially raised and partially recessed relative to the first major surface 44.

Figure 6:
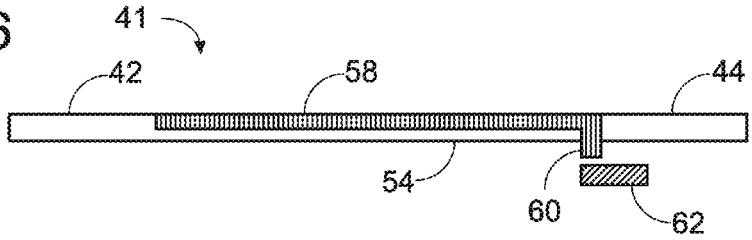
FIG. 6 is a cross-section view of the dielectric coupler device of FIG. 5 along the line indicated in FIG. 5.

FIG. 6 shows a cross-section view of the dielectric coupler device 41 of FIG. 5. As shown, dielectric coupler device 41 includes a dielectric end member 60 disposed at the first end 48 of the dielectric body 58, and extending through the aperture 56 in the conductive body 42. The dielectric end member 60 helps to direct any EHF electromagnetic signal propagated along the dielectric body 58 to a transmission destination, such as an integrated circuit package 62. In one embodiment, the aperture 56 may be formed as a slot having a narrow dimension less than one-half of the expected EHF signal wavelength to be transmitted as measured in the dielectric material, and a width dimension of greater than one such wavelength. In one particular embodiment, the aperture 56 may be a defined slot measuring approximately 5.0 mm by 1.6 mm.

In another embodiment of the invention, a dielectric coupler device as described above may be configured so that it may mate with a complementary second dielectric coupler device, so that in combination they form a dielectric coupling system. For example, where each conductive body defines a recess in the major surface of that conductive body, the conductive bodies may be mated in a face-to-face relationship so that the recesses collectively form an elongate cavity. The combined conductive bodies may in this way define an electrically conductive housing, within which the dielectric body of each coupler is superimposed with the other to form a collective dielectric body that is configured to conduct an EHF electromagnetic signal along the collective dielectric body.

Figure 7:
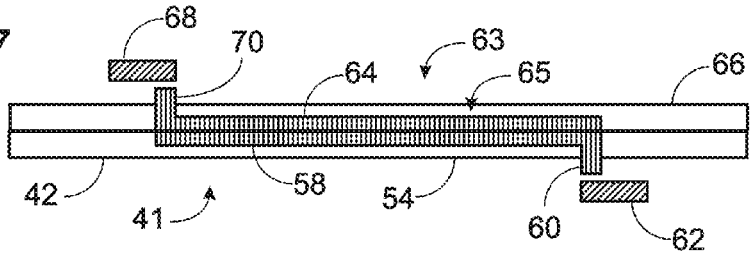
FIG. 7 is a cross-section view of a dielectric coupling according to an embodiment of the present invention, including the dielectric coupler of FIG. 5.

For example, and as shown in FIG. 7, first dielectric coupler device 41 is mated with complementary second dielectric coupler device 63 in such a way that first dielectric body 58 is superimposed with a second dielectric body 64 to form a collective dielectric body 65. At the same time, second conductive body 66 of second dielectric coupler device 63 may mate with first conductive body 42 to form an electrically conductive housing that at least partially surrounds the collective dielectric body 65 formed by dielectric bodies 58 and 64, and thereby provide shielding for the EHF electromagnetic signals propagated between an EHF transmission source and destination such as, for example, communication chips 62 and 68. The desired EHF electromagnetic signal may be directed into and out of the collective dielectric body 65 via first dielectric end member 60 and a second dielectric end member 70 disposed at each end of the collective dielectric body 65, and extending through apertures 56 and 72 in the electrically conductive housing defined by the first and second conductive bodies 42 and 66, respectively. The dielectric components of the resulting coupling system may be, but need not necessarily be, in direct mechanical or physical contact. If the dielectric components are disposed with a relative spacing and orientation that permits transmission and/or propagation of the desired EHF electromagnetic signal, then that spacing and orientation is an appropriate spacing and orientation for the coupling system.

The configuration of the combined dielectric coupling system 72 may be useful, for example, to minimize spurious radiation transmission by impairing the function of a single component dielectric coupler device 41 until two complementary dielectric coupler devices are mated to form the corresponding coupling system.

As shown in FIG. 7, the first and second devices 41 and 63 may be symmetrically related by an improper rotation, also known as rotary reflection or rotoflection. That is, the geometry of first and second devices 41 and 63 may be related by a rotation of 180 degrees combined with a reflection across a plane orthogonal to the axis of rotation. In the case of devices 41 and 63, the two coupler devices share a common geometry, and are simply disposed in the appropriate relationship to one another to form the desired coupling system. In an alternative embodiment, one or the other coupler devices may be uniquely shaped so that they may be assembled with improper rotational symmetry, but cannot be assembled with an undesired geometry.

Figure 8:
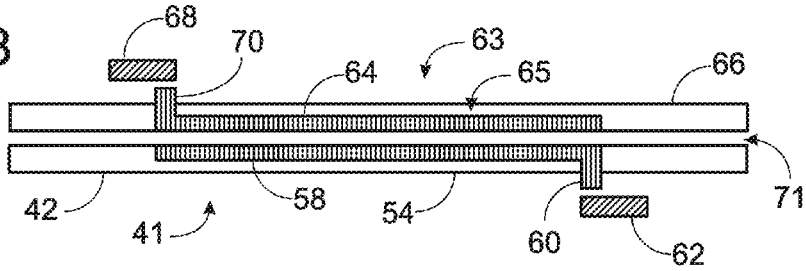
FIG. 8 shows the dielectric coupling of FIG. 7 exhibiting an air gap between its component dielectric coupler devices.

The dielectric coupling systems of the present invention provide relatively robust transmission of EHF electromagnetic signals. For example, EHF electromagnetic signals may be successfully transmitted from integrated circuit package 62 to integrated circuit package 68 even when an air gap 71 may exist between the first dielectric body 58 and the second dielectric body 64, as shown in FIG. 8. It has been determined, for example, that successful communication between integrated chip packages is possible even when the air gap 71 is as large as 1.0 mm. By facilitating EHF electromagnetic communication without requiring physical contact between the dielectric bodies, the dielectric coupling systems of the present invention may provide an additional degree of freedom when incorporating the coupling system into an EHF communication system. For example, the two coupler devices may be utilized within a coupling system where the two devices must be able capable of longitudinal translation while maintaining the integrity of the EHF electromagnetic waveguide. Where the two dielectric bodies are in physical contact, such movements may result in friction and wear upon the dielectric bodies, resulting in premature failure of the coupling system. However, by providing an air gap between the first and second dielectric bodies, translation between the two coupler devices may advantageously occur substantially without friction between the dielectric bodies.

Figure 9:
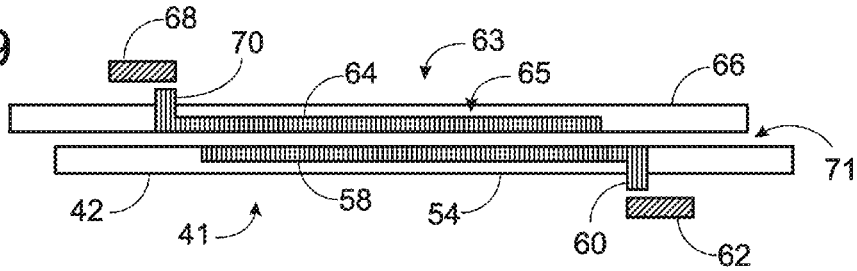
FIG. 9 shows the dielectric coupling of FIG. 7 exhibiting an air gap and misalignment between its component dielectric coupler devices.

In addition, EHF electromagnetic communication between integrated circuit package 62 and integrated circuit package 68 may be maintained even when dielectric bodies 58 and 64 are longitudinally misaligned, as shown in FIG. 9, conferring yet an additional degree of mechanical freedom when installing, adjusting, or operating the dielectric couplings of the present invention.

Figure 10:
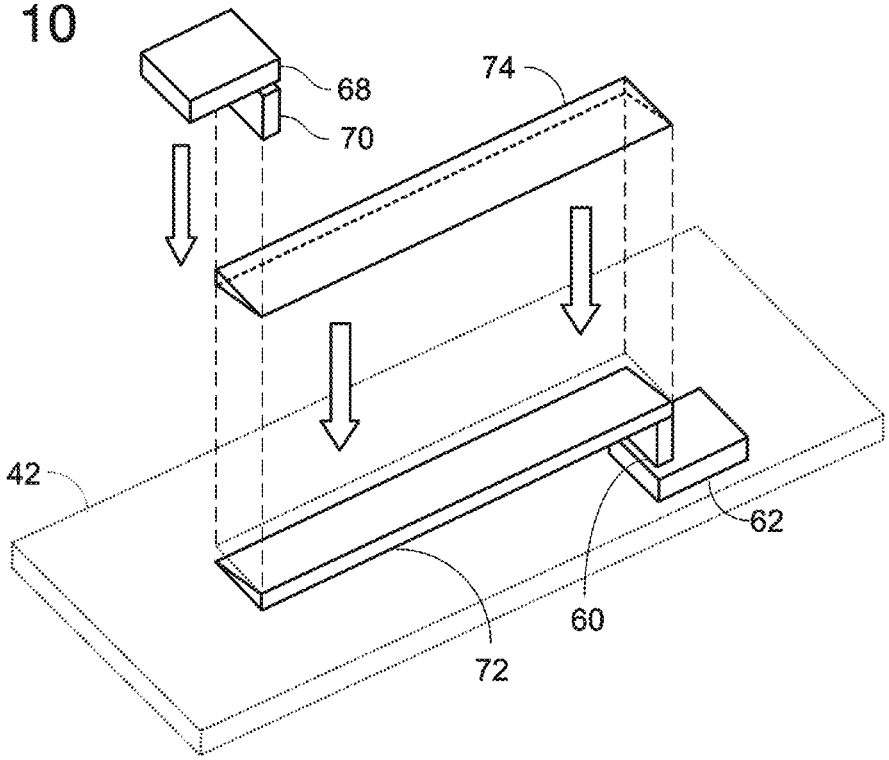
FIG. 10 is a partially exploded perspective view of a dielectric coupler device according to an alternative embodiment of the present invention.

As discussed above, the first and second dielectric bodies may include planar mating surfaces that may be at least partially continuous and/or coplanar with the major surface around and adjacent to their respective elongate recesses. Alternatively, the first and second dielectric bodies may possess an alternative geometry, provided that the first and second dielectric bodies remain configured to form a collective dielectric body when superimposed. In one embodiment, each dielectric body may be beveled in such a way that each dielectric body forms an elongate right triangular prism of dielectric material that is shaped and sized so that when combined they form a collective dielectric body that is an elongate cuboid. As shown in FIG. 10, each of a first beveled dielectric body 72 and second beveled dielectric body 74 are beveled across their widths, and the slope of each bevel is selected so that when dielectric bodies 72 and 74 are superimposed in the desired orientation, the collective dielectric body forms an elongate cuboid of dielectric material. The resulting collective dielectric body, in combination with dielectric end portions 60 and 70, forms a dielectric waveguide that extends between integrated circuit packages 62 and 68. A variety of alternative complementary dielectric body geometries may be envisioned, such as dielectric bodies designs that are each half the desired collective dielectric body width, thickness, or length; or that have partial or discontinuous lengths or widths; or some other symmetrical or nonsymmetrical complementary shapes and sizes.

As discussed above, where the first and second dielectric end portions extend through the first and second apertures, respectively, defined in the electrically conductive bodies that surround the collective dielectric body, the dielectric end portions are configured to direct the desired EHF electromagnetic signal into and/or out of the collective dielectric body. Typically, both the transmission source of the EHF electromagnetic signal and the receiver of the EHF electromagnetic signal are disposed adjacent one of the dielectric end portions, so as to facilitate transmission of the EHF electromagnetic signal. Where the source and/or destination of the EHF electromagnetic signal incorporate a transducer, the transducer is typically configured to transmit or receive EHF electromagnetic signals, and is typically disposed adjacent to one of the dielectric end portions in such a way that the transducer(s) are appropriately aligned with the adjacent dielectric end member that EHF electromagnetic signals may be transmitted therebetween.

Figure 11:
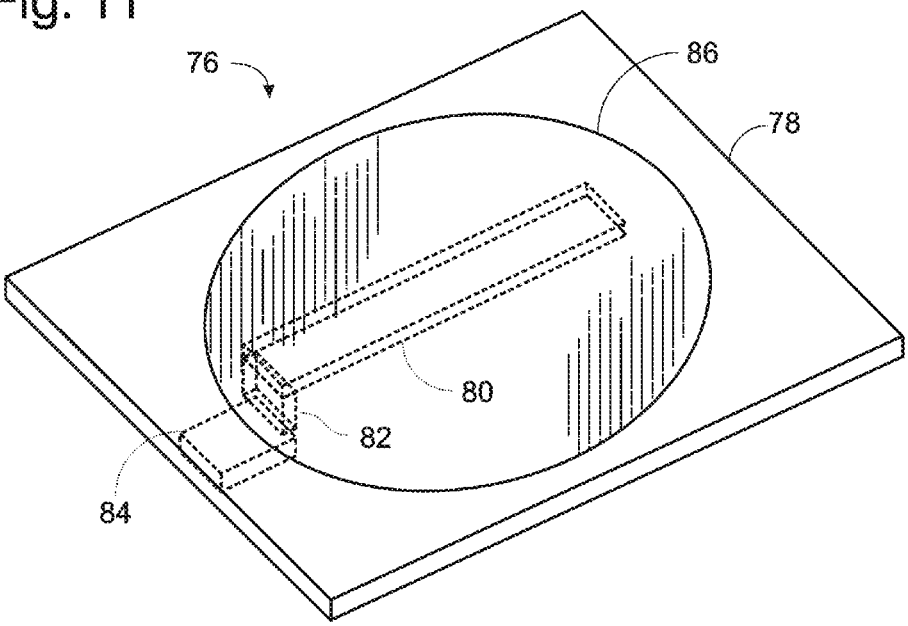
FIG. 11 is a perspective view of a dielectric coupler device according to an alternative embodiment of the present invention.

FIG. 11 depicts a dielectric coupler device 76 according to an alternative embodiment of the invention. Dielectric coupler device 76 includes an electrically conductive body 78, a dielectric body 80 disposed in a recess in the electrically conductive body, a dielectric end member 82 extending through an aperture in the conductive body 78, and an associated integrated circuit package 84 disposed adjacent the dielectric end member 82. In addition, dielectric coupler device 76 includes a dielectric overlay 86 that extends over dielectric body 80. Dielectric overlay 86 may be fashioned from the same or different dielectric material as dielectric body 80, and may be either discrete from dielectric body 80, or may be integrally molded with dielectric body 80. The dielectric overlay 86 may exhibit any desired shape or geometry but is typically sufficiently thin that the dielectric overlay would be substantially unable to conduct the EHF electromagnetic signal of interest separately from the dielectric body. The dielectric overlay 86 may have an ornamental shape, such as depicting a company logo or other decoration, or the overlay may serve a useful purposes, such as providing a guide to facilitate alignment of the coupler device.

Alternatively, or in addition, the dielectric overlay 86 may serve to hide the construction and/or geometry of the coupler device 76 itself from a user or other observer.

FIGS. 12-22 depict selected additional embodiments of the dielectric coupler device and/or coupling system of the present invention. Throughout FIGS. 12-22, like reference numbers may be used to indicate corresponding or functionally similar elements.

Figure 12:
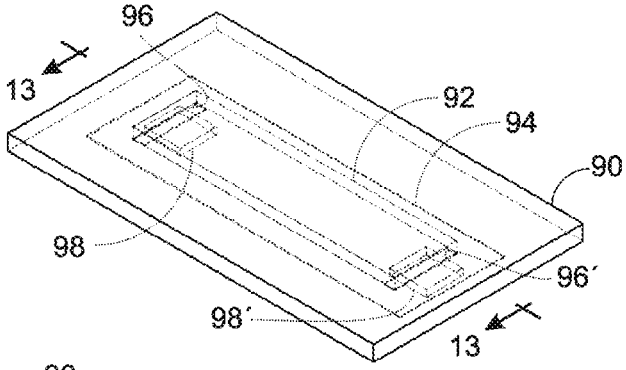
FIG. 12 is a perspective view of a dielectric coupling device according to an embodiment of the present invention.
Figure 13:
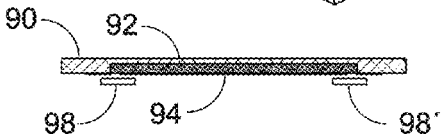
FIG. 13 is a cross-section view of the dielectric coupling of FIG. 12 along the line indicated in FIG. 12.

FIGS. 12 and 13 depict a dielectric coupler device according to an embodiment of the present invention, including an electrically conductive body 90 defining a recess, and a dielectric body 92 set into the defined recess. The dielectric body 92 of FIGS. 12 and 13 is covered by an electrically conductive overlay 94, as discussed above with respect to FIG. 11, and the conductive overlay defines a first apertures 96 and a second aperture 96' proximate to a first end and a second ends of the dielectric body 92, respectively. Adjacent to apertures 96 and 96' are a first and second integrated circuit package 98 and 98', respectively. EHF electromagnetic signals to be transmitted between the first integrated circuit package 98 to the second integrated circuit package 98' first pass through the first aperture 96 in the conductive overlay 94, are then propagated along the length of dielectric body 92, through the second aperture 96', and into the second integrated circuit package 98'.

Figure 14:
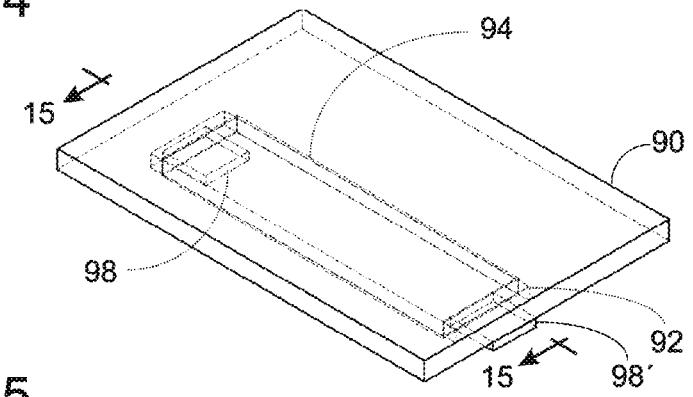
FIG. 14 is a perspective view of a dielectric coupling device according to another embodiment of the present invention.
Figure 15:
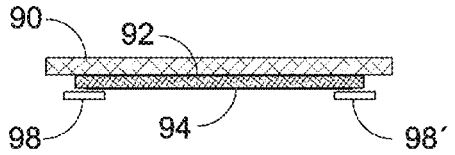
FIG. 15 is a cross-section view of the dielectric coupling of FIG. 14 along the line indicated in FIG. 14.

FIGS. 14 and 15 depict a dielectric coupler device according to an alternative embodiment of the present invention, including an electrically conductive body 90, and a dielectric body 92 which is disposed against a surface of the conductive body 90, and is covered by an electrically conductive overlay 94. The dielectric body 92 extends beyond the conductive overlay 94 at each end, permitting EHF electromagnetic signals to be transmitted between a first integrated circuit package 98 and a second integrated circuit package 98'.

Figure 16:
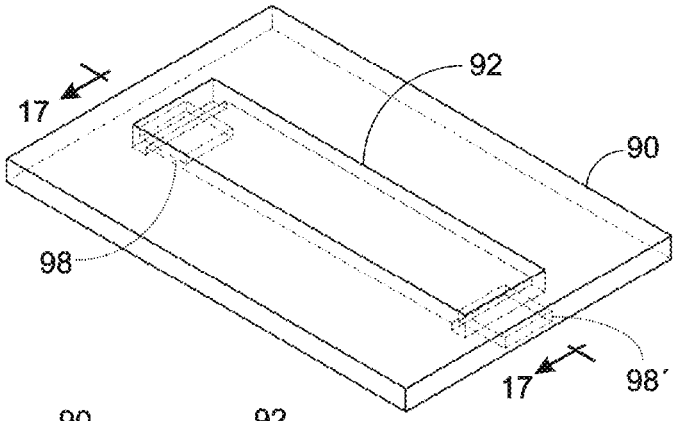
FIG. 16 is a perspective view of a dielectric coupling device according to yet another embodiment of the present invention.
Figure 17:
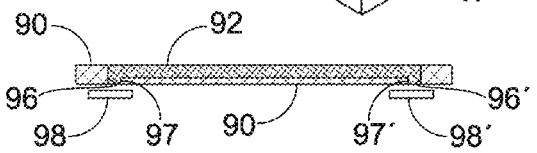
FIG. 17 is a cross-section view of the dielectric coupling of FIG. 16 along the line indicated in FIG. 16.

FIGS. 16 and 17 depict a dielectric coupler device according to yet another embodiment of the present invention, including an electrically conductive body 90 defining a recess, where the recess floor defines a first aperture 96 and a second aperture 96' at the respective ends of the recess. The apertures 96 and 96' extend through the conductive body to the opposite major surface of the conductive body 90. A dielectric body 92 is disposed within the defined recess, with a first dielectric end portion 97 extending from the dielectric body 92 through the first aperture 96 to the opposite major surface of the conducive body 90, and with a second dielectric end portion 97' extending from the dielectric body 92 through the second aperture 96' to the opposite major surface of the conducive body 90. Adjacent to apertures 96 and 96' are a first and second integrated circuit packages 98 and 98', respectively. An EHF electromagnetic signal to be transmitted, for example, from the first integrated circuit package 98 to the second integrated circuit package 98' first passes through the first dielectric end portion 97 in the first aperture 96, and is then propagated along the length of dielectric body 92, through the second dielectric end portion 97' in the second aperture 96', and into the second integrated circuit package 98'.

Figure 18:
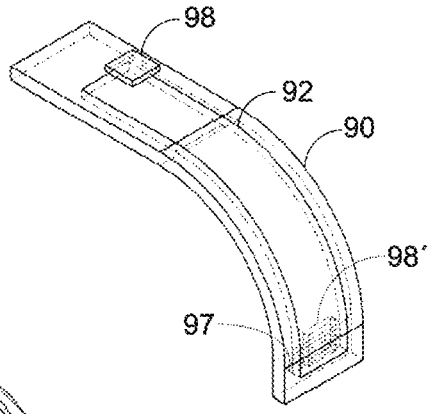
FIG. 18 is a perspective view of a dielectric coupling device according to yet another embodiment of the present invention.
Figure 19:
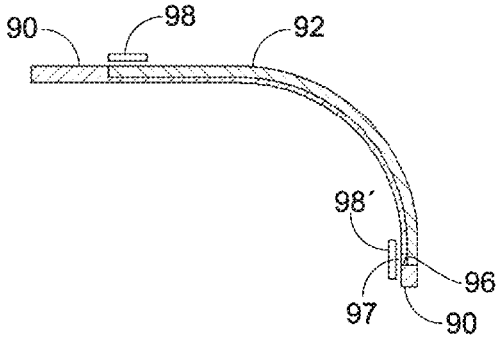
FIG. 19 is a cross-section view along the longitudinal axis of the dielectric coupling of FIG. 18.

FIGS. 18 and 19 depict a dielectric coupler device according to yet another embodiment of the present invention, including an electrically conductive body 90 which is non-planar. The first major surface of electrically conductive body 90 is a curved surface, including a recess defined in the curved surface and a dielectric body 92 disposed within the recess. An aperture 96 in the electrically conductive body 90 is defined by the floor of the recess, and a dielectric end portion 97 extends from the dielectric body 92 into the aperture 96. A first integrated circuit package 98 is disposed adjacent a first end of the dielectric body 92, while a second integrated circuit package 98' is disposed adjacent the dielectric end portion 97. An EHF electromagnetic signal to be transmitted from the first to the second integrated circuit packages first passes into the first end of the dielectric body 92, and is then propagated along the curving length of the dielectric body, through the dielectric end portion 97 in the aperture 96, and thereby into the second integrated circuit package 98'.

Figure 20:
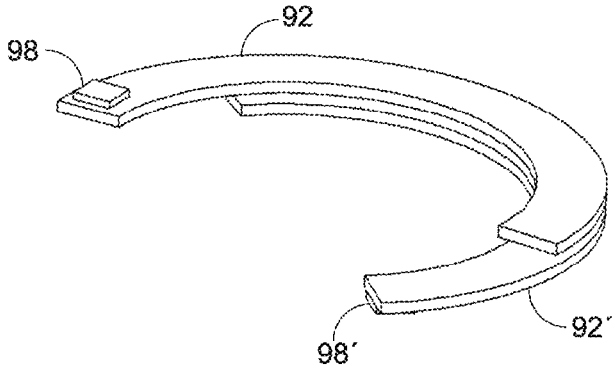
FIG. 20 is a perspective view of a dielectric coupling device according to yet another embodiment of the present invention.

FIG. 20 depicts a dielectric coupling according to yet another embodiment of the present invention, including a first integrated circuit package 98 that is disposed adjacent a first end of a first dielectric body 92 that is planar and has a smoothly curving outline. The first dielectric body 92 substantially overlaps and is aligned with a second dielectric body 92' that is similarly planar and curved, while a second integrated circuit package 98' is disposed adjacent the end of the second dielectric body 92', albeit on the opposite side relative to the first integrated circuit package. The depicted dielectric coupling permits EHF electromagnetic signals to be transmitted between the first and second integrated circuit packages even when the first and second dielectric bodies 92 and 92' are rotationally translated. The freedom of movement between the first and second dielectric bodies may be enhanced by separating them with a small air gap, which does not substantially interfere with EHF electromagnetic signal transmission.

Figure 21:
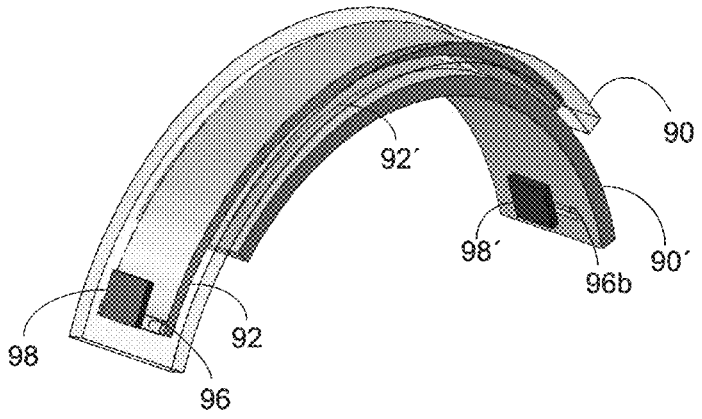
FIG. 21 is a perspective view of a dielectric coupling device according to yet another embodiment of the present invention.
Figure 22:
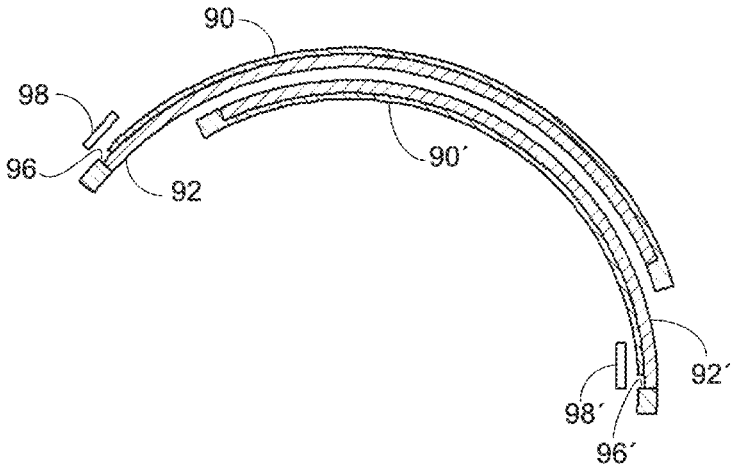
FIG. 22 is a cross-section view along the longitudinal axis of the dielectric coupling of FIG. 21.

FIGS. 21 and 22 depict a dielectric coupling according to yet another embodiment of the present invention, the dielectric coupling including a first and second coupler device. The first coupler device includes a first electrically conductive body 90 defining a curving surface. A recess is defined along the inside surface of the first conductive body 90, and a dielectric body 92 is disposed within the first recess. A first aperture 96 is defined in the conductive body 90, and a first integrated circuit package 98 is disposed adjacent to the first aperture 96. A second coupler device including a second curving conductive body 90' is disposed inside the curve of the first coupler device, and a second elongate recess is defined in the second conductive body 90' of the second coupler device, along the outside surface of the second conductive body 90'. The first and second coupler devices are configured so that a second dielectric body 92' disposed in the second elongate recess is substantially aligned with, and substantially overlaps with, the first dielectric body 92' of the first coupler device. The second coupler device further includes a second aperture 96' defined by the conductive body 90' extending through the second conductive body 90' to an adjacent second integrated circuit package 98'. EHF electromagnetic signals to be transmitted between the first and second integrated circuit packages pass from integrated circuit package 98 into the first dielectric body 92 via aperture 96. The signal is then propagated along the collective dielectric body formed by first dielectric body 92 and second dielectric body 92', and then through the second aperture 96', where they may be received by the second integrated circuit package 98'. Similar to the dielectric coupling of FIGS. 19 and 20, the dielectric coupling of FIGS. 21 and 22 permits EHF electromagnetic signals to be transmitted between the first and second integrated circuit packages even when the first and second dielectric bodies 92 and 92' are translated along their respective curves, provided sufficient overlap exists between the respective dielectric bodies. The freedom of movement between the first and second dielectric bodies may be enhanced by providing a small air gap between them, which does not substantially interfere with EHF electromagnetic signal transmission.

Figure 23:
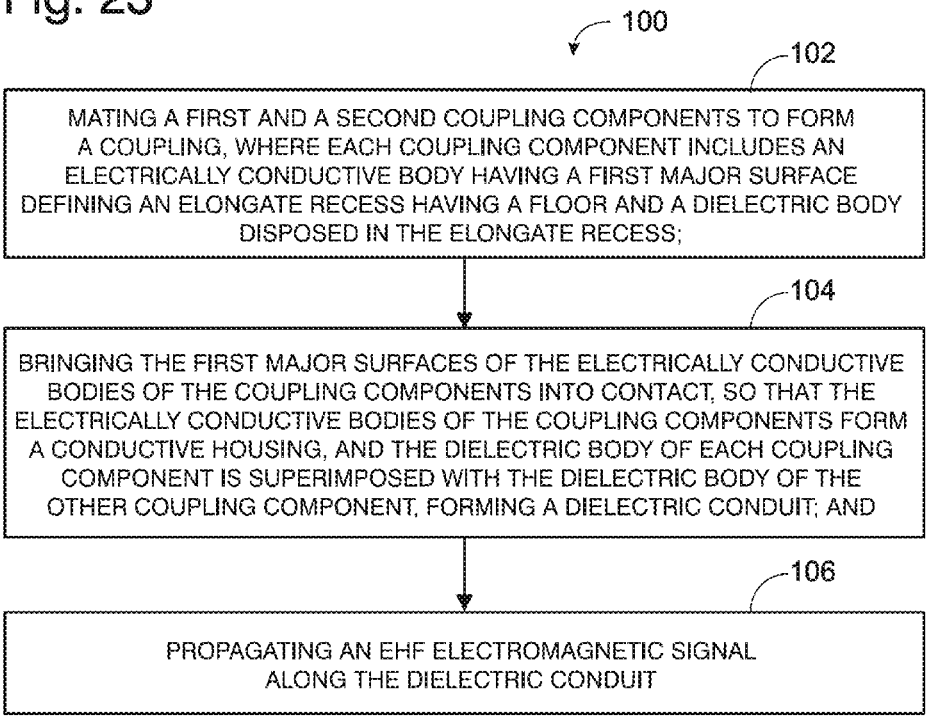
FIG. 23 is a flowchart illustrating a method for communicating using EHF electromagnetic signals along a dielectric coupling, according to an embodiment of the present invention.

The dielectric couplings of the present invention possess particular utility for a method of communicating using EHF electromagnetic signals, as shown in flowchart 100 of FIG. 23. The method may include mating a first and a second coupling components to form a coupling at 102, where each coupling component includes an electrically conductive body having a first major surface, where each electrically conductive body defines an elongate recess in the first major surface, each elongate recess having a floor, and each elongate recess having a dielectric body disposed therein. Mating the first and second coupling components may include bringing the first major surfaces of the electrically conductive bodies of the coupling components into contact at 104, so that the electrically conductive bodies of the coupling components collectively form a conductive housing, and the dielectric body of each coupling component is superimposed with the dielectric body of the other coupling component, and forms a dielectric conduit. The method may further include propagating an EHF electromagnetic signal along the resulting dielectric conduit at 106.

It is to be understood that the phraseology or terminology herein is for the purpose of description and not of limitation, such that the terminology or phraseology of the present specification is to be interpreted by the skilled artisan in light of the teachings and guidance.

While the present disclosure is amenable to various modifications and alternative forms, specific embodiments are shown by way of example in the drawings and are described in detail. It should be understood, however, that the drawings and detailed description thereto are not intended to limit the present disclosure to the particular form disclosed, but on the contrary, the intention is to cover all modifications, equivalents, and alternatives falling within the spirit and scope of the present disclosure as defined by the appended claims.

What is claimed is:

1. A device for conducting an EHF electromagnetic signal, comprising:

a first electrically conductive body having a first major surface, the first electrically conductive body defining a first elongate recess in the major surface, the first elongate recess having a floor;

a first dielectric body disposed in the first elongate recess and configured to conduct the EHF electromagnetic signal; and a surface overlay disposed on the first major surface of the first electrically conductive body and covering at least a portion of a length of the first dielectric body;

wherein:

the first electrically conductive body includes a second major surface opposite the first major surface;

the floor of the first elongate recess defines a first aperture through the first electrically conductive body, the aperture extending from the recess floor to the second major surface adjacent a first end of the first elongate recess; and the device further comprising a first dielectric end member disposed at a first end of the first elongate recess and extending through the first aperture in the first electrically conductive body.

2. The device of claim 1, wherein the aperture is a substantially rectangular slot defined in the floor of the first elongate recess; the slot having a slot width measured along a longitudinal axis of the first elongate recess, and a slot length measured along a width of the first elongate recess;

wherein the slot width is less than about one-half of the wavelength of the EHF electromagnetic signal, and the slot length is greater than a wavelength of the EHF electromagnetic signal.

3. The device of claim 1, further comprising an integrated circuit package disposed proximate to the dielectric end member where it extends through the aperture, wherein the integrated circuit package includes an EHF electromagnetic signal transducer configured to receive the EHF electromagnetic signal from the dielectric end member or to transmit the EHF electromagnetic signal to the dielectric end member.

4. The device of claim 3, wherein the EHF signal transducer includes an antenna, and the antenna is substantially aligned with the dielectric end member.

5. The device of claim 1, wherein the first dielectric body includes a mating surface that is substantially continuous with the first major surface of the electrically conductive body around and adjacent to the first elongate recess.

6. The device of claim 1, wherein the electrically conductive body is a portion of a case of an electronic apparatus.

7. A device for conducting an EHF electromagnetic signal, comprising:

a first electrically conductive body having a first major surface, the first electrically conductive body defining a first elongate recess in the major surface, the first elongate recess having a floor;

a first dielectric body disposed in the first elongate recess and configured to conduct the EHF electromagnetic signal; and a second device for conducting the EHF electromagnetic signal, the second device including:

a second electrically conductive body including a first major surface; the second electrically conductive body defining a second elongate recess in the first major surface of the second electrically conductive body, the second elongate recess having a floor; and a second dielectric body disposed in the second elongate recess; wherein the first and second devices are configured to be mated by bringing the first major surface of each electrically conductive body substantially proximate to the other so that the first and second dielectric bodies form a collective dielectric body that is configured to conduct the EHF electromagnetic along the collective dielectric body.

8. The device of claim 7, wherein the first and second dielectric bodies are aligned and in physical contact with each other.

9. The device of claim 7, wherein the relative orientations of the first and second devices are related by rotary reflection.

10. The system of claim 7, wherein each dielectric body is capable of propagating EHF electromagnetic signals independently of the other dielectric body.

11. The device of claim 7, wherein the collective dielectric body forms an elongate cuboid of dielectric material for propagating polarized EHF electromagnetic signals.

12. The device of claim 11, wherein each of the first and second dielectric bodies are configured not to conduct the EHF electromagnetic signal between first and second ends of the at least one of the first and second elongate recesses when the first and second dielectric bodies are not superimposed.

13. The device of claim 11, wherein each of the first and second dielectric bodies include elongate right triangular prisms of dielectric material configured so that when the first and second devices are mated the collective dielectric body forms the elongate cuboid.

14. The device of claim 7, wherein the second electrically conductive body includes a second major surface opposite the first major surface;

the floor of the second elongate recess defines a second aperture in the second electrically conductive body adjacent a first end of the second elongate recess, the second aperture extending from the second recess floor to the second major surface of the second electrically conductive body; and the second dielectric body including a second dielectric end member disposed at the first end of the second elongate recess and extending through the second aperture in the second electrically conductive body; and the first and second dielectric end members are disposed at opposite ends of the collective dielectric body.

15. The device of claim 14, further comprising:

a first integrated circuit package disposed proximate to the first dielectric end member where it extends through the first aperture, the first integrated circuit package including a first EHF electromagnetic signal transducer; and a second integrated circuit package disposed proximate to the second dielectric end member where it extends through the second aperture, the second integrated circuit package including a second EHF electromagnetic signal transducer;

wherein the collective dielectric body and the first and second dielectric end members, in combination, form a waveguide for EHF electromagnetic signals configured to conduct the EHF electromagnetic signal between the first EHF electromagnetic signal transducer and the second EHF electromagnetic signal transducer.

16. The coupling of claim 15, wherein at least one of the first and second EHF electromagnetic signal transducers includes an EHF antenna that is disposed in substantial alignment with the proximate one of the first and second dielectric end members.

17. A device for conducting an EHF electromagnetic signal, comprising:

a first electrically conductive body including a first major surface and a second major surface opposite the first major surface;

a first dielectric body disposed on the first major surface, the first dielectric body having a first end and a second end and wherein the first dielectric body is configured to conduct the EHF electromagnetic signal between the first and second end;

provided that the first electrically conductive body defines at least one aperture extending from the first major surface to the second major surface; and the at least one aperture is proximate one of the first and second ends of the first dielectric body;

wherein each aperture is a substantially rectangular slot defined in the electrically conductive body; the slot having a slot width that is less than about one-half of the wavelength of the EHF electromagnetic signal, and the slot having a slot length that is greater than a wavelength of the EHF electromagnetic signal; and a first dielectric end member disposed within and extending through the at least one aperture in the first electrically conductive body.

18. The device of claim 17, further comprising an integrated circuit package disposed proximate to the dielectric end member where it extends through the aperture, wherein the integrated circuit package includes an EHF electromagnetic signal transducer configured to receive the EHF electromagnetic signal from the dielectric end member or to transmit the EHF electromagnetic signal to the dielectric end member.

19. An EHF communication coupling system, comprising:

an electrically conductive housing;

an elongate dielectric conduit having a first end and a second end, the dielectric conduit being disposed between and at least partially enclosed by the electrically conductive housing;

wherein the electrically conductive housing defines a first aperture proximate the first end of the elongate dielectric conduit and a second aperture proximate the second end of the elongate dielectric conduit;

a first dielectric extension that projects from the first end of the elongate dielectric conduit and through the first aperture in the first housing portion;

a second dielectric extension that projects from the second end of the elongate dielectric conduit and through the second aperture in the second housing portion;

wherein the coupling system is configured to propagate at least a portion of an EHF electromagnetic signal between the first dielectric extension and the second dielectric extension by way of the elongate dielectric conduit.

20. The system of claim 19, wherein the first and second apertures are defined on opposite sides of the electrically conductive housing.

21. The system of claim 19, wherein the electrically conductive housing is a portion of a case for an electronic apparatus.

22. The system of claim 19, wherein the electrically conductive housing includes a first housing portion and a second housing portion, each of the first housing portion and second housing portion having an internal face; and the electrically conductive housing is formed by mating the housing portions in a face-to-face relationship.

23. The system of claim 19, wherein each housing portion defines a recess in its internal face, such that when the housing portions are mated in a face-to-face relationship the recesses collectively form an elongate cavity; and wherein the elongate dielectric conduit is disposed within and at least partially enclosed by the elongate cavity formed thereby.

24. The system of claim 19, wherein the elongate dielectric conduit includes an elongate cuboid of a dielectric material.

25. The system of claim 24, wherein the elongate dielectric conduit includes a first dielectric portion and a second dielectric portion, such that the first and second dielectric portions collectively form the elongate cuboid of a dielectric material.

26. The system of claim 25, wherein each dielectric portion has a substantially constant thickness that substantially corresponds to one-half of a total thickness of the elongate cuboid.

27. The system of claim 24, wherein each dielectric portion is capable of propagating EHF electromagnetic signals independently of the other dielectric portion.

28. The system of claim 24, wherein each dielectric portion has a substantially constant width that substantially corresponds to one-half of a total width of the elongate cuboid.

29. The system of claim 24, wherein each dielectric portion substantially corresponds to an elongate right triangular prism.

30. The system of claim 19, further comprising:

a first integrated circuit package that includes a first EHF electromagnetic signal transducer, wherein the first integrated circuit package is disposed on an exterior of the electrically conductive housing proximate the first dielectric extension; and a second integrated circuit package that includes a second EHF electromagnetic signal transducer, wherein the second integrated circuit package is disposed on the exterior of the electrically conductive housing proximate the second dielectric extension.

31. The system of claim 30, wherein the coupling system is configured to propagate at least a portion of an EHF electromagnetic signal between the first EHF electromagnetic signal transducer and the second EHF electromagnetic signal transducer via the first dielectric extension, the elongate dielectric conduit, and the second dielectric extension.

32. A method of communicating using EHF electromagnetic signals, comprising:

mating a first and a second coupling components to form a coupling, each coupling component including an electrically conductive body having a first major surface, where each electrically conductive body defines an elongate recess in the first major surface, each elongate recess having a floor, and each elongate recess having a dielectric body disposed therein; wherein mating the first and second coupling components includes:

bringing the first major surfaces of the electrically conductive bodies of the coupling components into sufficient contact to form an electrically conductive housing, wherein the dielectric bodies of the coupling components are superimposed to form a dielectric conduit; and propagating an EHF electromagnetic signal along the dielectric conduit;

wherein:

each of the first and second coupling components includes a dielectric extension that abuts the dielectric body and projects through an aperture defined by the electrically conductive body; and mating the first and second coupling components includes forming a coupling wherein each of the dielectric extensions abuts a respective end of the resulting dielectric conduit and projects through the electrically conductive housing.

33. The method of claim 32, wherein propagating the EHF electromagnetic signal along the dielectric conduit includes receiving the EHF electromagnetic signal at one of the dielectric extensions and propagating the EHF electromagnetic signal through the one dielectric extension and along the dielectric conduit to the other of the dielectric extensions.

34. The method of claim 33, wherein propagating the EHF electromagnetic signal includes transmitting an EHF electromagnetic signal from a first integrated circuit package having an EHF transducer proximate to and at least substantially aligned with one of the dielectric extensions, and receiving the EHF electromagnetic signal at a second integrated circuit package having an EHF transducer proximate to and at least substantially aligned with the other dielectric extension.

* * * * *